US011240611B2

(12) United States Patent
Spieler et al.

(10) Patent No.: US 11,240,611 B2
(45) Date of Patent: Feb. 1, 2022

(54) HEARING DEVICE COMPRISING A SENSOR UNIT AND A COMMUNICATION UNIT, COMMUNICATION SYSTEM COMPRISING THE HEARING DEVICE, AND METHOD FOR ITS OPERATION

(71) Applicant: Sonova AG

(72) Inventors: Ivo Spieler, uml a+ee fa (CH); Andreas Breitenmoser, Zurich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/035,762

(22) Filed: Sep. 29, 2020

(65) Prior Publication Data

US 2021/0099813 A1 Apr. 1, 2021

(30) Foreign Application Priority Data

Sep. 30, 2019 (EP) ..... 19200353

(51) Int. Cl.
*H04R 25/00* (2006.01)

(52) U.S. Cl.
CPC ..... *H04R 25/554* (2013.01); *H04R 25/43* (2013.01); *H04R 25/558* (2013.01)

(58) Field of Classification Search
CPC ..... H04R 25/554; H04R 25/43; H04R 25/558
USPC ..... 381/312
See application file for complete search history.

(56) References Cited

U.S. PATENT DOCUMENTS

| | | | |
|---|---|---|---|
| 8,199,947 B2 | 6/2012 | Rass | |
| 8,565,456 B2 | 10/2013 | Nishizaki et al. | |
| 9,532,147 B2 | 12/2016 | Scheller | |
| 9,699,574 B2 | 7/2017 | Gran et al. | |
| 9,900,686 B2 | 2/2018 | Virolainen et al. | |
| 9,906,875 B2 | 2/2018 | Mauler | |
| 10,117,604 B2 | 11/2018 | Boesen et al. | |
| 2010/0195836 A1 | 8/2010 | Platz | |
| 2012/0321112 A1 | 12/2012 | Schubert et al. | |
| 2016/0345107 A1 | 11/2016 | Van Dijk et al. | |
| 2018/0228405 A1* | 8/2018 | Burwinkle | A61B 5/0002 |
| 2018/0302738 A1 | 10/2018 | Di Censo | |
| 2018/0317024 A1 | 11/2018 | Roeck | |

FOREIGN PATENT DOCUMENTS

| | | |
|---|---|---|
| DE | 102006028682 A1 | 1/2008 |
| EP | 3439327 A1 | 2/2019 |
| WO | 2018071630 A1 | 4/2018 |
| WO | 2018153642 A1 | 8/2018 |

OTHER PUBLICATIONS

European Patent Office, International Searching Authority, European Search Report, dated Mar. 26, 2020, Munich, Germany.

* cited by examiner

*Primary Examiner* — Phylesha Dabney
(74) *Attorney, Agent, or Firm* — ALG Intellectual Property, LLC

(57) ABSTRACT

The disclosure relates to a hearing device configured to be worn at an ear of a user, the hearing device comprising a sensor unit configured to provide sensor data; and a communication unit configured to receive remote data from a remote device. The disclosure further relates to a communication system comprising the hearing device and the remote device and to a method of operating the hearing device and the remote device.

18 Claims, 13 Drawing Sheets

HEARING DEVICE COMPRISING A SENSOR UNIT AND A COMMUNICATION UNIT, COMMUNICATION SYSTEM COMPRISING THE HEARING DEVICE, AND METHOD FOR ITS OPERATION

CROSS-REFERENCE APPLICATION(S)

The present application claims priority to European Patent Application No. 19200353.1 titled "Hearing device comprising a sensor unit and a communication unit, communication system comprising the hearing device, and method for its operation," filed on Sep. 30, 2019, which is incorporated by reference herein for its entirety.

TECHNICAL FIELD

This disclosure relates to a hearing device comprising a sensor unit configured to provide sensor data, a communication unit configured to receive remote data from a remote device, and a processing unit communicatively coupled with the sensor unit and the communication unit. The disclosure further relates to a communication system comprising the hearing device and a remote device.

BACKGROUND

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to produce a sound in a user's ear canal. Sound may be communicated by a wire or wirelessly to a hearing device, which may reproduce the sound in the user's ear canal. Hearing devices are often employed in conjunction with remote devices, such as smartphones, for instance when a user is listening to sound data processed by the remote device and/or during a phone conversation operated by the remote device.

Various types of sensors can be included in a hearing device. Typically, a hearing instrument includes at least a microphone to detect sound and to output an amplified and/or signal processed version of the sound to the user. Another type of sensor implemented in a hearing device can be a user interface such as a switch or a push button by which the user can adjust a hearing device operation, for instance a sound volume of an audio signal output by the hearing device and/or a parameter of a signal processing performed by a processing unit of the hearing device. Further types of sensors include voice activity detectors (VADs) configured to detect an own voice activity of the user and/or a speech recognition. More recently, additional sensor types have been increasingly implemented with hearing devices, in particular sensors which are not directly related to the sound reproduction and/or amplification function of the hearing device. Those sensors include inertial measurement units (IMUs), such as accelerometers, for detecting a movement and/or an orientation of the hearing device which may be recorded over time and/or relative to a reference axis such as an axis defined by the gravitational force. IMUs may also be used for detection of a user interacting the hearing device, for instance by tapping on the hearing device which can be measurable as an acceleration of the hearing device caused by the tapping. Other sensors integrated into hearing devices are employed for detecting a physical property of the user, in particular for monitoring a health parameter of the user. Some examples of health monitoring sensors include optical sensors, such as photoplethysmogram (PPG) sensors that can be used to detect properties of a blood volume flowing through a probed tissue, and electrophysical sensors, such as electrocardiogram (ECG) sensors recording an electrical activity of the heart, electroencephalography (EEG) sensors detecting electrical activity of the brain, and electrooculography (EOG) sensors to measure an electric potential that exists between the front and back of the human eye. Other hearing device sensors include temperature sensors configured to determine a body temperature of the user and/or a temperature of an ambient environment. Further examples include pressure sensors and/or contact sensors configured to determine a contact of the hearing device with the ear. Further examples include humidity sensors configured to determine a humidity level inside and/or outside an ear canal.

On the other hand, data communication devices such as smartphones, smartwatches, tablets, etc. which are connectable to a hearing device as a remote device are also increasingly equipped with different sensor types, including some of the sensors described above. The sensors, however, are then usually applied in a different environment remote from the ear of the user, for instance at a location at which the communication device is intended to be worn by the user, such as on a palm of a hand or on a wrist of an arm or in a pocket, or at a location at which the communication device is intended for a stationary use, such as on a desk. The sensor data collected by the sensors of a hearing device and by the sensors of a communication device thus may deviate in some respects, even when an identical type of sensors is employed, and may correspond in other respects, even when a different type of sensors is employed. In some situations, the sensor data collected by the hearing device may be more accurate or significant than the sensor data collected by the communication device, in other situations the opposite may occur. Generally, it may not be obvious to the user of both devices which sensor data is more reliable in the different situations. Moreover, an increased accuracy and reliability would be desirable for the sensor data obtained by each of the devices.

SUMMARY

It is an object of the present disclosure to avoid at least one of the above-mentioned disadvantages and to provide a hearing device and/or a communication system comprising the hearing device and a remote device and/or a method of operating the hearing device and/or the operation system with an improved accuracy and/or reliability of recorded sensor data indicative of a physical property detected on the user and/or in an environment of the user. It is a further object to augment the information value of sensor data obtained by a hearing device and/or a remote device connectable to the hearing device. It is another object to provide an improved mode of operation of the hearing device and/or a remote device connectable to the hearing device when providing sensor data, in particular to allow a reduced power consumption during data collection.

At least one of these objects can be achieved by a hearing device comprising the features of the claims.

The present disclosure proposes a hearing device configured to be worn at an ear of a user. The hearing device comprises a sensor unit configured to provide sensor data. The sensor data is indicative of a physical property detected on the user and/or in an environment of the hearing device.

The hearing device further comprises a communication unit configured to receive remote data from a remote device via a communication link. The remote device may be operable at a position remote from the ear at which the hearing device is worn. The hearing device further comprises a processing unit communicatively coupled with the sensor unit and the communication unit. The processing unit is configured to determine whether a degree of correlation between information in the sensor data and information in the remote data is above or below a threshold. The processing unit is also configured to select, depending on said degree of correlation relative to the threshold, an operation for providing output data from a first operation and a second operation. In the first operation, the output data is based on information including information in the remote data. In the second operation, the output data is based on information in the sensor data such that information in the remote data is disregarded in the output data. The processing unit is also configured to provide the output data by performing the selected operation.

According to the disclosure, determining the degree of correlation between the sensor data and the remote data relative to the threshold can be employed, by the processing unit, to select between different operations for providing the output data indicative of the physical property in a way that can offer various advantages. On the one hand, the selecting depending on the degree of correlation whether the output data is based on information including the information in the remote data, or the output data is based on the information in the sensor data can increase accuracy and/or reliability of the output data by ensuring that the remote data is only considered in the output data when it can contribute to such an improvement. In particular, it can be avoided that a consideration of the remote data in the output data would lead to a downgrade or falsification of the output data as compared to the sensor data. Moreover, a better quality of the output data can be expected by enriching the sensor data with the remote data depending on the degree of correlation relative to the threshold, for instance, by adding missing information to the sensor data from the remote data, providing a check of the information in the sensor data by verifying a presence of correlated information in the remote data, and/or by providing complementary and/or related information from the remote data to the information in the sensor data. On the other hand, the selecting depending on the degree of correlation can be exploited to provide an estimate whether the information contained in the sensor data is of a sufficient quality. In particular, it can be estimated whether considering the remote data in the output data would lead to a further improvement of the quality of the output data or not. In the latter case, the information in the remote data may be disregarded in the output data. This may be exploited for a less processing intensive generation of the output data and/or a decreased power consumption required for generation of the output data.

Independently, the present disclosure proposes a communication system. The communication system comprises a hearing device configured to be worn at an ear of a user, and a remote device operable at a position remote from the ear at which the hearing device is worn and configured to provide remote data. The hearing device comprises a sensor unit configured to provide sensor data. The sensor data is indicative of a physical property detected on the user and/or in an environment of the hearing device. Each of the hearing device and the remote device comprises a communication unit configured to mutually communicate the sensor data and/or the remote data via a communication link. At least one of the hearing device and the remote device comprises a processing unit communicatively coupled with the respective communication unit. The processing unit is configured to determine whether a degree of correlation between information in the sensor data and information in the remote data is above or below a threshold. The processing unit is also configured to select, depending on said degree of correlation relative to the threshold, an operation for providing output data from a first operation and a second operation. In the first operation, the output data is based on information including information in the remote data. In the second operation, the output data is based on information in the sensor data such that information in the remote data is disregarded in the output data. The processing unit is also configured to provide the output data by performing the selected operation.

Independently, the present disclosure proposes a method of operating a hearing device and/or communication system. The method comprises communicating sensor data and/or remote data via a communication link between the hearing device and the remote device. The method further comprises determining whether a degree of correlation between information in the sensor data and information in the remote data is above or below a threshold. The method further comprises selecting, depending on the degree of correlation relative to the threshold, an operation for providing output data from a first operation and a second operation. In the first operation, the output data is based on information including information in the remote data. In the second operation, the output data is based on information in the sensor data such that information in the remote data is disregarded in the output data. The method further comprises providing the output data by performing the selected operation.

Independently, the present disclosure includes a non-transitory computer-readable medium storing instructions that, when executed by a processor or processors, cause a hearing device to perform operations of the method of operating a hearing device and/or of the method of operating a communication system described above.

Subsequently, additional features of some implementations of the hearing device and/or the method of operating a hearing device are described. Each of those features can be provided solely or in combination with at least another feature. The features may be correspondingly applied in some implementations of the hearing device and/or the method of operating the hearing device and/or the communication system and/or the method of operating the communication system and/or the computer-readable medium.

The providing the output data based on information including information in the remote data can comprise providing the output data exclusively based on information in the remote data or providing the output data based on information in the remote data and on information in the sensor data. For instance, the output data can include information derived from the remote data, which may be extended by also including information derived from the sensor data and/or by also including information derived from a comparison between the remote data and the sensor data and/or information provided by a subsequent operation depending on the comparison. The providing the output data based on information including information in the sensor data can comprise providing the output data exclusively based on information in the sensor data. Whether the output data is based on information including information in the remote data, or the output data is based on information in the sensor data, can depend on the degree of correlation relative to the threshold, as determined by the processing unit.

A correlation, as used herein, may be any relationship, in particular any statistical relationship, between the information in the sensor data and in the remote data. The degree of correlation may be any indicator suitable for quantifying the relationship between the information in the sensor data and in the remote data.

A remote device, as used herein, may be any device operable at a position remote from the ear at which the hearing device is worn. In some implementations, the remote device is configured to be operated remote from the ears of the user. In some implementations, the remote device is configured to be operated at a body portion of an individual, in particular the user, remote from the ears of the individual. In some implementations, the remote device is wearable and/or configured to be worn by an individual during operation of the remote device and/or during transport of the remote device by the individual. In some implementations, the remote device is configured to be operated stationary independent from a body position of an individual.

The sensor unit may be configured to provide the sensor data with various information types. The information types may include audio information indicative of a sound in an environment of the hearing device and/or with movement information indicative of a movement and/or orientation of the hearing device and/or with body information indicative of a physical property of the user wearing the hearing device and/or with user input information indicating a user interaction from a user interface of the hearing device and/or with own voice information indicative of an own voice activity of the user and/or with proximity information indicative of a proximity of the hearing device to the remote device and/or with connection information indicative of a quality of a connection of the hearing device to the remote device via the communication link and/or with temperature information and/or with altitude information and/or with humidity information.

The remote device may be configured to provide the remote data with various information types. The information types may include audio information indicative of a sound in an environment of the remote device and/or with movement information indicative of a movement and/or orientation of the remote device and/or with body information indicative of a physical property of the user wearing the remote device and/or with user input information indicating a user interaction from a user interface of the remote device and/or with own voice information indicative of an own voice activity of the user and/or with proximity information indicative of a proximity of the hearing device to the remote device and/or with connection information indicative of a quality of a communication connection between the hearing device and the remote device via the communication link and/or with temperature information and/or with altitude information and/or with humidity information. The remote device may also be configured to provide the remote data with data received from another remote device.

The degree of correspondence may be determined between information of at least one information type in the sensor data and information of at least one information type in the remote data. It may be that at least one of the information types of the information in the sensor data corresponds to at least one of the information types of the information in the remote data. In this way, the output signal may be provided with an increased accuracy and/or reliability with respect to the corresponding information type as compared to the sensor data, when the first operation is performed. Furthermore, the output signal may be augmented by information derived from the corresponding information type as compared to the sensor data.

It may be that at least one of the information types of the information in the sensor data is different from the at least one information type of the information in the remote data. It may also be that at least one of the information types of the information in the remote data is different from the at least one information type of the information in the sensor data. In this way, the output signal may be augmented by information derived from the different information type as compared to the sensor data, when the first operation is performed. Moreover, the different information type may also contribute to an increased accuracy and/or reliability of the output signal.

The processing unit may be configured to determine the degree of correlation relative to the threshold at different times, and to determine a resulting degree of correlation after said different times. In this way, a reliability of the determined degree of correlation provided by the resulting degree of correlation may be enhanced.

The processing unit may be configured to select the first operation when the degree of correlation is determined to be above the threshold, and to select the second operation when the degree of correlation is determined to be below the threshold. In particular, such an operation may be implemented as a first operational mode of the processing unit. Thus, in the first operation, the output data may be based on information including information in the remote data when the degree of correlation is determined to be above the threshold, and the output data may be based on information in the sensor data when the degree of correlation is determined to be below the threshold. When the degree of correlation is above the threshold, the output data may be based on information in the remote data, or the output data may be based on information in the remote data and on information in the sensor data. This operation may be employed, for instance, when an increased correlation between the sensor data and the remote data above, as determined by the degree of correlation above the threshold, shall be exploited to provide output data having an increased quality with respect to the sensor data by including information in the output data which has been obtained from the remote data. When the degree of correlation is below the threshold, such an increased quality of the output data may not be expected.

The processing unit may be configured to select the first operation when the degree of correlation is determined to be below the threshold, and to select the second operation when said degree of correlation is determined to be above the threshold. In particular, such an operation may be implemented as a second operational mode of the processing unit. When the degree of correlation is below the threshold, the output data may thus be based on information in the remote data, or the output data may be based on information in the remote data and on information in the sensor data. This operation may be employed, for instance, when an increased correlation between the sensor data and the remote data, as determined by the degree of correlation above the threshold, shall be exploited as an indicator for a sufficiently good quality of the sensor data such that the remote data may be disregarded in the output data and the output data can be based on the sensor data. When the degree of correlation is below the threshold, the quality of the sensor data may not be expected to be good enough for achieving a sufficiently good quality of the output data such that the output data can be based on information including information in the remote data.

The processing unit may be configured to selectively perform the first operational mode, or the second operational mode, as defined above. The processing unit may also be configured to perform the first operational mode, wherein the second operational mode is not implemented. The processing unit may also be configured to perform the second operational mode, wherein the first operational mode is not implemented.

The threshold may be a first threshold, wherein the processing unit is configured to determine whether the degree of correlation is above or below a second threshold. The first threshold can represent a lower degree of correlation between the information in the sensor data and the information in the remote data than the second threshold. The processing unit can further be configured to select the first operation when said degree of correlation is determined to be above the first threshold and below the second threshold. The processing unit can further be configured to select the second operation when the degree of correlation is determined to be below the first threshold or above the second threshold. In this way, the advantages of the first operational mode and the second operational mode, as described above, may be combined in a single operational mode.

The processing unit may be configured to select the first operation from a third operation and a fourth operation, wherein in the third operation the output data is based on information including information in the sensor data and information in the remote data, and in the fourth operation the output data is based on information in the remote data such that information in the sensor data is disregarded in the output data. In particular, the threshold may be a first threshold, wherein the processing unit is configured to determine whether the degree of correlation is above or below a second threshold, the first threshold representing a lower degree of correlation between the information in the sensor data and the information in the remote data than the second threshold, and to select the third operation when the degree of correlation is determined to be above the first threshold and below the second threshold, to select the second operation when said degree of correlation is determined to be below the first threshold, and to select the fourth operation when the degree of correlation is determined to be above the second threshold. In this way, an improved accuracy and/or better reliability of the remote data may be employed to replace the sensor data in case of a poor degree of correlation which may indicate a bad quality of the sensor data.

The sensor unit may be configured to provide the sensor data with information depending on whether the hearing device is worn at the ear of the user. The information in the remote data and the threshold can be selected such that the degree of correlation is determined by the processing unit to be above the threshold when the remote device is worn by the user in addition to the hearing device worn at the ear of the user. In this way, the degree of correlation above the threshold can be an indicator for both the hearing device and the remote device being worn by the user. Correlated information in the sensor data and in the remote data, which can arise from the remote device worn by the user in addition to the hearing device worn at the ear of the user, can thus be exploited to provide the output signal when the degree of correlation is determined to be above the threshold.

The sensor unit may be configured to provide the sensor data with proximity information indicative of a proximity of the hearing device to the remote device and/or with connection information indicative of a quality of a connection of the hearing device to the remote device via the communication link. The processing unit may be configured to determine said degree of correlation to be above the threshold when the proximity information indicates that a minimum proximity is exceeded and/or when the connection information indicates that a minimum connection quality is exceeded, and when the information in the remote data fulfills another criterion which is independent of said proximity and/or said quality of the connection. Thus, the degree of correlation above the threshold may be an indicator for a proximity and/or connection criterion fulfilled in the sensor data and another criterion independent of the proximity and/or connection criterion in the remote data. Correlated information in the sensor data and in the remote data, which can arise from the proximity and/or connection of the remote device to the hearing device in conjunction with another information in the remote device, can thus be exploited to provide the output signal when the degree of correlation is determined to be above the threshold.

The sensor unit may be configured to provide the sensor data with body information indicative of a physical property of the user wearing the hearing device and/or with movement information indicative of a movement and/or orientation of the hearing device. The processing unit may be configured to determine the degree of correlation between the information in the sensor data, including the body information and/or movement information, and the information in the remote data. The information in the remote data can include movement information indicative of a movement and/or orientation of the remote device and/or location information indicative of a location of the remote device.

The sensor unit may be configured to provide the sensor data with audio information indicative of a sound in an environment of the hearing device. The processing unit may be configured to determine the degree of correlation between the information in the sensor data, including the audio information, and the information in the remote data. The information in the remote data can include audio information indicative of a sound in an environment of the remote device.

Determining the degree of correlation may comprise correlating microphone signals as sensor data from the microphone on the hearing aid and the microphone signals as remote data from the remote device, such as a smartphone that is connected to the hearing device system. The correlation (for example, the Pearson's Correlation Coefficient, Maximal Information Coefficient, Kullback-Leibler divergence) may be computed by processing the data directly or by computing features, metadata, or other properties from the data. This may be used for calibrating and correlating the underlying sensor data and remote data. For example, by classification of sensor data as well as remote data by an Artificial Intelligence algorithm, the resulting classes may be compared and used for calibrating in indicating a correlation between the classes.

The processing unit may be configured, after the first operation has been selected, to provide the output data by calibrating the information in the remote data based on the information in the sensor data, and/or calibrating the information in the sensor data based on the information in the remote data, and/or complementing the information in the sensor data with the information in the remote data. The processing unit may be further configured to provide the output data by including the calibrated and/or complemented information in the output data.

The complementing the information in the sensor data with the information in the remote data may comprise overriding or combining data, which is less accurate and/or precise and/or reliable and/or significant with data that is more accurate and/or precise and/or reliable and/or significant; alternatively, complementing may comprise extending data in case that one of the connected devices was not able to record data that are available in another device as well. Again, this may be achieved by computing similarity measures or correlations, or detecting changes or gaps in the data series. The calibrating the information in the sensor data based on the information in the remote data may comprise checking and/or adjusting and/or determining a correction of the sensor data by a comparison with the remote data.

The remote device may be wearable by the user. The information in the remote data may depend on whether the remote device is worn by the user.

The remote device may be a first remote device. The communication unit of the first remote device may be configured to establish a communication link with a communication unit of a second remote device and to receive data from the second remote device via the communication link. The remote data provided from the first remote device to the communication unit of the hearing device may comprise the data received by the first remote device from the second remote device.

The communication link between the communication unit of the first remote device and the communication unit of the second remote device may comprise an internet connection and/or a mobile phone connection.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings.

DETAILED DESCRIPTION OF THE DRAWINGS

Devices, systems, and methods for processing sensor data of a sensor implemented with a hearing device in conjunction with remote data communicated to the hearing device are described herein. In particular, output data can be provided depending on a degree of correlation between information in the sensor data and information in the remote data. Such output data may be employed to improve the sensor data and/or the remote data and/or operations to provide such output data may be employed for other functional improvements of the hearing device. Those and other advantages will become apparent in the description that follows.

Figure 1:
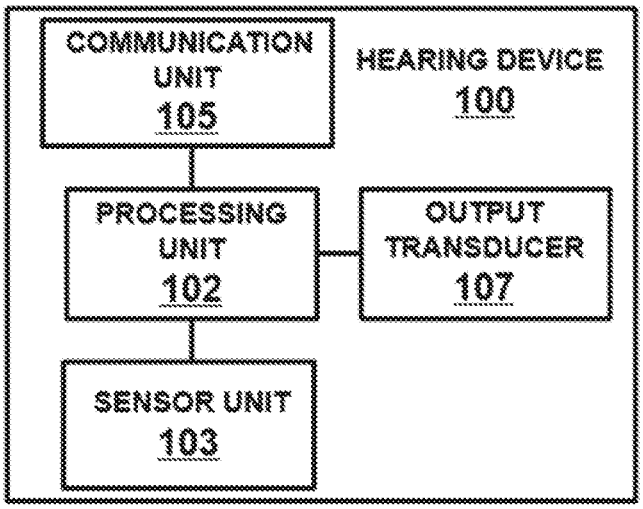
FIG. 1 schematically illustrates an exemplary hearing device including a processing unit, a sensor unit, a communication unit, and an output transducer.

FIG. 1 illustrates an exemplary hearing device 100 configured to be worn at an ear of a user. Hearing device 100 may be implemented by any type of hearing device configured to enable or enhance hearing by a user wearing hearing device 100. For example, hearing device 100 may be implemented by a hearing aid configured to provide an amplified version of audio content to a user, a sound processor included in a cochlear implant system configured to provide electrical stimulation representative of audio content to a user, a sound processor included in a bimodal hearing system configured to provide both amplification and electrical stimulation representative of audio content to a user, or any other suitable hearing prosthesis.

Different types of hearing devices 100 can also be distinguished by the position at which they are worn at the ear. Some hearing devices, such as behind-the-ear (BTE) hearing aids and receiver-in-the-canal (RIC) hearing aids, typically comprise an earpiece configured to be at least partially inserted into an ear canal of the ear, and an additional housing configured to be worn at a wearing position outside the ear canal, in particular behind the ear of the user. Some other hearing devices, as for instance earbuds, earphones, in-the-ear (ITE) hearing aids, invisible-in-the-canal (IIC) hearing aids, and completely-in-the-canal (CIC) hearing aids, commonly comprise such an earpiece to be worn at least partially inside the ear canal without an additional housing for wearing at the different ear position.

As shown, hearing device 100 includes a processing unit 102 communicatively coupled to a sensor unit 103, a communication unit 105, and an output transducer 107. Hearing device 100 may include additional or alternative components as may serve a particular implementation.

Output transducer 107 may be implemented by any suitable audio output device, for instance a loudspeaker or a receiver of a hearing device or an output electrode of a cochlear implant system.

Sensor unit 103 may be implemented by any suitable sensor configured to provide sensor data indicative of a physical property detected on the user wearing the hearing device and/or in an environment of the user, or by a combination of those sensors. For instance, sensor data detected in the environment can be representative for a sound in the environment, a temperature of the environment, humidity of the environment, an altitude, a location, a movement of the user in the environment, and/or the like. Sensor data detected on the user can be representative for a body temperature, heartrate, blood values of the user, an electrical activity of the user's body, bone conducted vibrations during a speech of the user, a user interaction with the hearing device, and/or the like. A sound detector implemented in sensor unit 103 may generate audio data that can be output by output transducer 107.

Communication unit 105 may be implemented by any data receiver and/or a data transmitter and/or a data transducer configured to exchange data with a remote device via a communication link. Thus, communication unit 105 can be configured to receive remote data from the remote device and/or to transmit the sensor data to the remote device. To this end, communication unit 105 can be configured to selectively establish a communication link with the remote device for a mutual data communication, in particular a wireless communication link. For instance, data may be communicated in accordance with a Bluetooth™ protocol and/or by any other type of radio frequency communication such as, for example, data communication via an internet connection and/or a mobile phone connection. The remote data may comprise any data provided from the remote device, for instance, sensor data, location data, time data, etc. The remote data may also comprise audio data, such as music data processed by the remote device and/or data of a phone call signal and/or a phone conversation signal transmitted from the remote device and/or data recorded by a remote microphone, which can be output by output transducer 107.

Processing unit 102 may be configured to access remote data received by communication unit 105 from a remote device and/or to access sensor data generated by sensor unit 103. Processing unit 102 may be configured to process the sensor data and/or the remote data in accordance with a sensor data processing program to provide output data based on information contained in the sensor data and/or the remote data. To this end, hearing device 100 may further include a memory which maintains data representative of a sensor data processing program, or a variety of programs. The memory may be implemented by any suitable type of storage medium and may be configured to maintain (e.g., store) data generated, accessed, or otherwise used by processing unit 102. The memory may be implemented with processing unit 102 and/or provided as a component additional to processing unit 102. Processing unit 102 may also be configured to control transmission of the sensor data to a remote device and/or receiving of remote data from the remote device via communication unit 105. Processing unit 102 may be further configured to perform various processing operations with respect to audio data detected by sensor unit 103 and/or received by communication unit 105. For example, processing unit 102 may be configured to process an audio content contained in the audio data in accordance with a sound processing program to present the audio content to the user. The sound processing program or programs may also be stored in a memory of hearing device 100.

Figure 2:
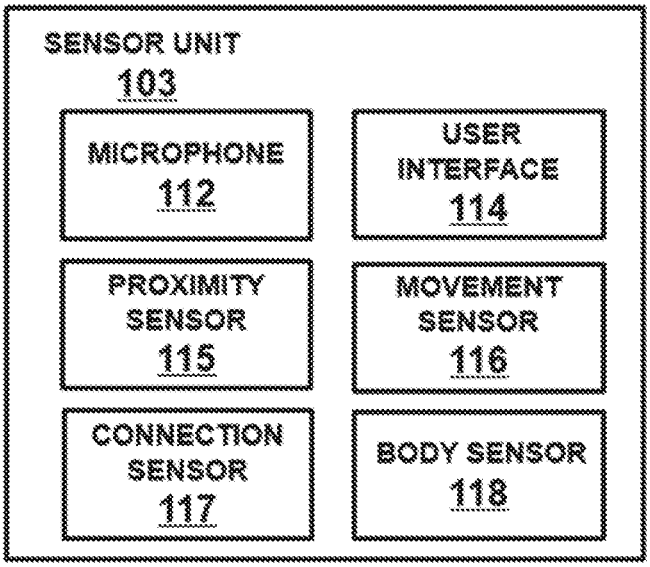
FIG. 2 schematically illustrates an exemplary sensor unit that may be implemented with the hearing device illustrated in FIG. 1.

FIG. 2 illustrates an example of sensor unit 103 implemented in hearing device 100, according to some embodiments of the present disclosure. As shown, sensor unit 103 includes a microphone 112, a user interface 114, a proximity sensor 115, a movement sensor 116, a connection sensor 117, and a body sensor 118. In some other embodiments, sensor unit 103 may comprise at least one sensor 112, 114, 115, 116, 118, or a different number of those sensors. In further embodiments, sensor unit 103 may comprise other types of sensors or additional sensors. Those sensors may include an altitude sensor, a temperature sensor, a barometric sensor, a location sensor, such as for instance a receiver for signals from a global positioning system (GPS), a humidity sensor, a wind detector, a voice activity detector (VAD), etc.

Microphone 112 may be implemented by any suitable sound detection device to detect sound presented to a user of the hearing device, and to provide sensor data in the form of audio data based on the detected sound. The audio data (e.g., a digitized version of an audio signal) may include, for example, audio content (e.g., music, speech, noise, etc.) generated by one or more audio sources included in an environment of the user.

Movement sensor 116 may be implemented by any suitable sensor configured to detect a movement (e.g., acceleration) and/or an orientation of hearing device 100, and to provide corresponding sensor data in the form of movement data and/or orientation data. For instance, movement sensor 116 may be implemented by an inertial measurement unit (IMU), such as an accelerometer and/or gyroscope, or by a camera configured to detect movement, etc. While hearing device 100 is being worn by a user, the movement and/or orientation of hearing device 100 is representative of a movement and/or orientation of the user in the environment of the user.

User interface 114 may be implemented by any suitable sensor allowing to determine an interaction by a user, and to provide corresponding sensor data in the form of user input data. For instance, user interface 114 may comprise a push button and/or a touch sensor and/or a tapping detector provided at a surface of hearing device 100. User interface 128 may also be provided as an IMU, in particular an accelerometer, allowing to determine a user interaction causing a movement of hearing device 100, for instance a manual tapping on a housing of hearing device 100. User interface 128 may also be provided as a microphone allowing to determine a user interaction causing a sound, such as touching a surface of the microphone acoustically coupled to a sound detecting membrane of the microphone.

Proximity sensor 115 may be implemented by any suitable sensor configured to detect a proximity and/or distance of a remote device to hearing device 100, and to provide corresponding sensor data in the form of proximity data and/or distance data. Proximity may be defined by a distance between hearing device 100 and the remote device smaller than a threshold distance. To this end, proximity sensor 115 may be adapted to sense electric, electromagnetic, and/or magnetic fields generated by a remote device and/or hearing device 100. Proximity sensor 115 may also be adapted to sense other proximity indicators such as an intensity and/or phase difference of a sound and/or light emitted from a source. For instance, proximity sensor 115 may be implemented by a magnetic sensor and/or magnetometer as proximity sensor adapted to sense the strength of a magnetic field generated by a remote device and/or hearing device 100. A radio receiver of hearing device 100 and/or a remote device may also be used as proximity sensor 115, wherein a received signal strength (RSSI) measurement of a radio signal received at the radio receiver can be used for proximity determination. Such a proximity sensor 115 may be denoted as an RSSI sensor.

Connection sensor 117 may be implemented by any suitable sensor allowing to determine connection data indicative of a quality of a data communication connection between hearing device 100 and a remote device. The connection data may be indicative of an established communication link between hearing device 100 and a remote device and/or a quality of a data communication via the communication link. Connection sensor 117 may be provided, for instance, as a data communication connection which is automatically recognized by a processing unit such as, for instance, a data connection in accordance with a Bluetooth™ protocol. Connection sensor 117 may also be provided by a detector recognizing a data communication between the hearing device and a remote device in dependence of time, as for instance in dependence of a time elapsed since the data has been communicated for the last time at a preceding instant.

Body sensor 118 may be implemented by any suitable sensor allowing to determine a physical property on the user's body, and to provide corresponding sensor data, for instance in the form of physical condition data. In particular, body sensor 118 may include any sensor suitable for a health monitoring of the user. For instance, body sensor 118 may include an optical sensor, such as photoplethysmogram (PPG) sensors that can be used to detect properties of a blood volume flowing through a probed tissue, and/or an electrophysical sensor, such as electrocardiogram (ECG) sensors recording an electrical activity of the heart, electroencephalography (EEG) sensors detecting electrical activity of the brain, and electrooculography (EOG) sensors measuring an electric potential that exists between the front and back of the human eye, and/or a temperature sensor to determine a body temperature, and/or a humidity sensors to detect humidity at the ear. Body sensor 118 may also include any sensor suitable for detecting a contact of the hearing device with the body of the user and/or a placement of the hearing device at an ear of the user, in particular inside the ear canal. Those sensors may include pressure sensors and/or contact sensors.

Figure 3:
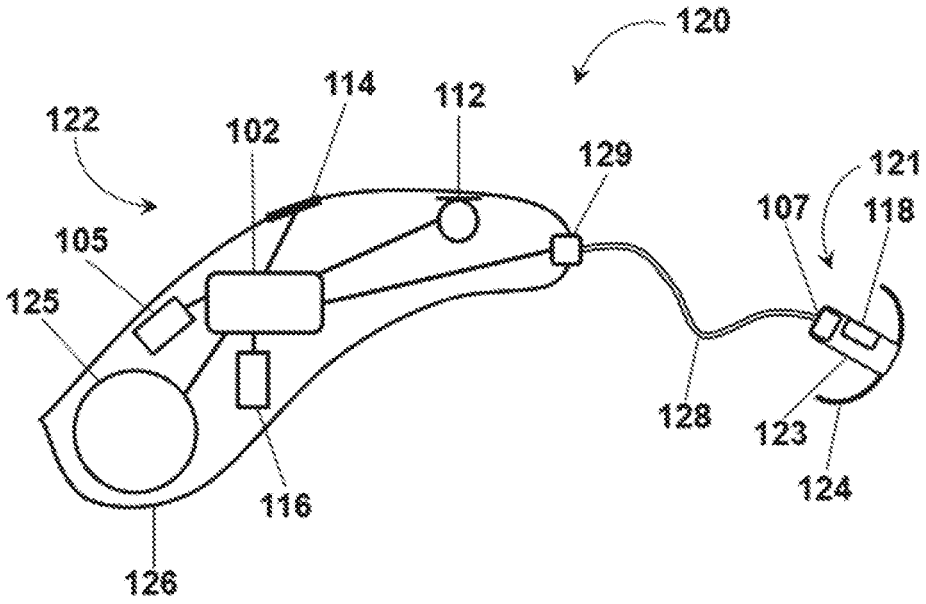
FIG. 3 schematically illustrates some embodiments of an exemplary hearing device in the form of a RIC hearing aid.

FIG. 3 illustrates exemplary implementations of hearing device 100 as a RIC hearing aid 120, in accordance with some embodiments of the present disclosure. RIC hearing aid 120 comprises a BTE part 122 configured to be worn at an ear at a wearing position behind the ear, and an ITE part 121 configured to be worn at the ear at a wearing position at least partially inside an ear canal of the ear. ITE part 121 is an earpiece comprising a housing 123 at least partially insertable in the ear canal. Housing 123 encloses output transducer 107 and body sensor 118. Body sensor 118 can thus be placed in the ear canal and/or at the concha of the ear when hearing device 120 is worn by the user. Housing 123 may further comprise a flexible member 124 adapted to contact an ear canal wall when housing 123 is at least partially inserted into the ear canal. In this way, an acoustical seal with the ear canal wall can be provided at the housing portion contacting the ear canal wall.

BTE part 122 comprises an additional housing 126 for wearing behind the ear. Additional housing 126 accommodates processing unit 102 communicatively coupled to communication unit 105, microphone 112, user interface 114, and movement sensor 116. BTE part 122 and ITE part 121 are interconnected by a cable 128. Processing unit 102 is communicatively coupled to output transducer 107 and body sensor 118 via cable 128 and a cable connector 129 provided at additional housing 122. Processing unit 102 can thus be configured to access audio data generated by microphone 112, to process the audio data, and to provide the processed audio data to output transducer 107. Processing unit 126 can further be configured to receive sensor data from microphone 112, user interface 114, movement sensor 116, and body sensor 118, to receive remote data from communication unit 105, and to process the sensor data and/or the remote data. BTE part 122 may further include a battery 125 as a power source for the above described components.

Figure 4:
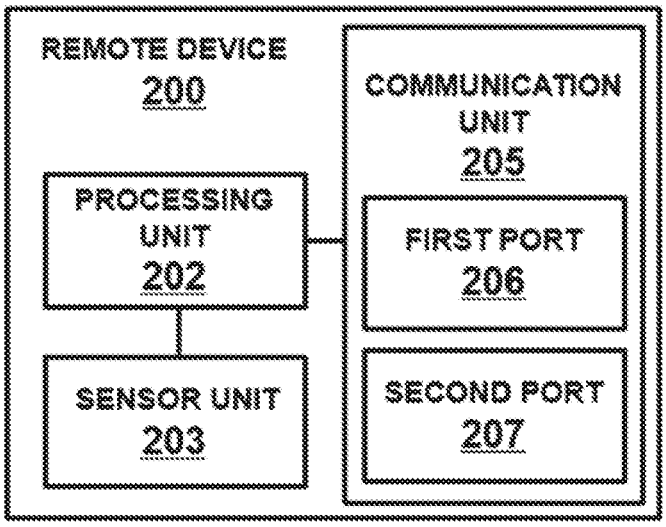
FIG. 4 schematically illustrates an exemplary remote device including a processing unit, a sensor unit, and a communication unit connectable to a hearing device.

FIG. 4 illustrates an exemplary remote device 200 operable at a position remote from the ear at which hearing device 100 is worn. Remote device 200 includes a processing unit 202 communicatively coupled to a sensor unit 203, and a communication unit 205. Remote device 200 may include additional or alternative components as may serve a particular implementation.

Sensor unit 203 may be implemented by any suitable sensor configured to detect a physical property at the position at which remote device 200 is disposed, and to provide sensor data indicative of the physical property, or by a combination of those sensors. The sensor data may be indicative of a physical property detected on the user wearing the hearing device and/or in an environment of the user. The sensor data may also be indicative of a physical property detected on an individual different from the user wearing the hearing device and/or in an environment remote from the environment of the user. In particular, sensor unit 203 may comprise at least one sensor corresponding to a sensor 112, 114, 115, 116, 117, 118 of sensor unit 103 illustrated in FIG. 2, or any number of those sensors. For instance, sensor unit 203 may comprise a microphone and/or a user interface, and/or a movement sensor, and/or a connection sensor and/or a proximity sensor and/or a body sensor and/or a location sensor and/or an altitude sensor and/or a barometric sensor, as described above. Remote data provided by remote device 200 can thus include the sensor data provided by sensor unit 203.

Communication unit 205 may be implemented by any data receiver and/or a data transmitter and/or a data transducer configured to exchange data with communication unit 105 of hearing device 100 via a communication link. Thus, communication unit 205 can be configured to transmit the remote data to hearing device 100 and/or to receive the sensor data from hearing device 100 via a communication link between communication unit 105 and communication unit 205. Communication unit 105 and communication unit 205 can be configured to selectively establish the communication link for a mutual data communication, in particular a wireless communication link, as described above.

Communication unit 205 may comprise a communication port 206 configured to communicate the sensor data and/or the remote data with communication unit 105 of hearing device 100 via the communication link. Communication port 206 can be a first communication port, and communication unit 205 may comprise a second communication port 207. Second communication port 207 can be configured to communicate data with another remote device and/or another hearing device different from hearing device 100. The communicated data may comprise the sensor data communicated by communication unit 105 of hearing device 100 and/or the remote data provided by remote device 200 and/or remote data provided by the other remote device and/or sensor data communicated by a communication unit of the other hearing device. Second communication port 207 can be configured to selectively establish a communication link with the other remote device and/or the other hearing device for a mutual data communication, in particular a wireless communication link.

The data may be communicated by any type of radio frequency communication including, for instance, data communication via an internet connection and/or a mobile phone connection and/or in accordance with a Bluetooth™ protocol. The data may also be communicated via an internet server. For instance, remote device 200 can be a first remote device and second communication port 207 can be configured to communicate the data with a second remote device. Hearing device 100 may also be a first hearing device and second communication port 207 can be configured to communicate the data with a second hearing device. For instance, the first hearing device and the second hearing device may be configured to be worn each at a different ear of the user in a binaural configuration. The first hearing device and the second hearing device may also be configured to be worn by different users, each hearing device at an ear of the respective user.

Processing unit 202 may be configured to access remote data generated by sensor unit 203 and/or to access sensor data received by communication unit 205 from hearing device 100 and/or to access remote data received by communication unit 205 from another remote device and/or to access remote data received by communication unit 205 from another hearing device different from hearing device 100, in particular sensor data from the other hearing device. Processing unit 202 may be configured to process the sensor data and/or the remote data in accordance with a sensor data processing program to provide an output data based on information contained in the data. Processing unit 202 may also be configured to control transmission of the remote data to hearing device 100 and/or receiving of sensor data from hearing device 100 and/or receiving of remote data from another remote device and/or another hearing device via communication unit 205.

Remote device 100 may be implemented by any type of device operable at a position remote from the ear at which hearing device 100 is worn and configured to provide remote data. In particular, remote device 100 may be implemented by a device wearable by a user, for instance on a body portion such as on a hand, arm, foot, leg, hip, neck, breast or belly, or wearable in a pocket or bag, and/or a device intended for stationary use, such as on top of a desk or in a server room. Some examples of wearable remote devices include smartphones, smartwatches, tablets, laptops, wearable sensor devices for health monitoring, and/or the like. In some implementations, remote device 100 may be implemented by any type of device operable at a position remote from an ear. In some implementations, remote device 100 may be implemented by another hearing device operable at a position remote from the ear at which hearing device 100 is worn. For instance, hearing device 100 may be a first hearing device and remote device 100 may be a second hearing device. In particular, the first and second hearing device may be configured to be worn by the same user at different ears in a binaural configuration or by different users at an ear of the respective user. Stationary remote devices may include desktop computers and/or stationary sensor devices for health monitoring.

Figure 5:
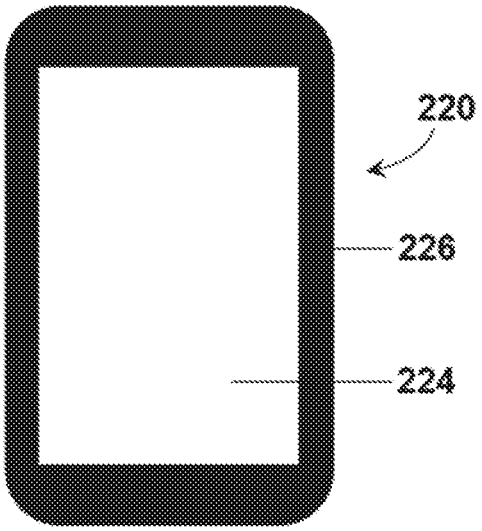
FIG. 5 schematically illustrates some embodiments of an exemplary remote device in the form of a smartphone.

FIG. 5 illustrates exemplary implementations of remote device 200 as a smartphone 220, in accordance with some embodiments of the present disclosure. Smartphone 220 comprises a housing 226 configured to be worn by a user at a position remote from an ear. Smartphone 220 further comprises a touchscreen 224 configured as a user interface. Other sensor types, such as a microphone, a movement sensor, etc. may also be implemented with smartphone 220.

Figure 6:
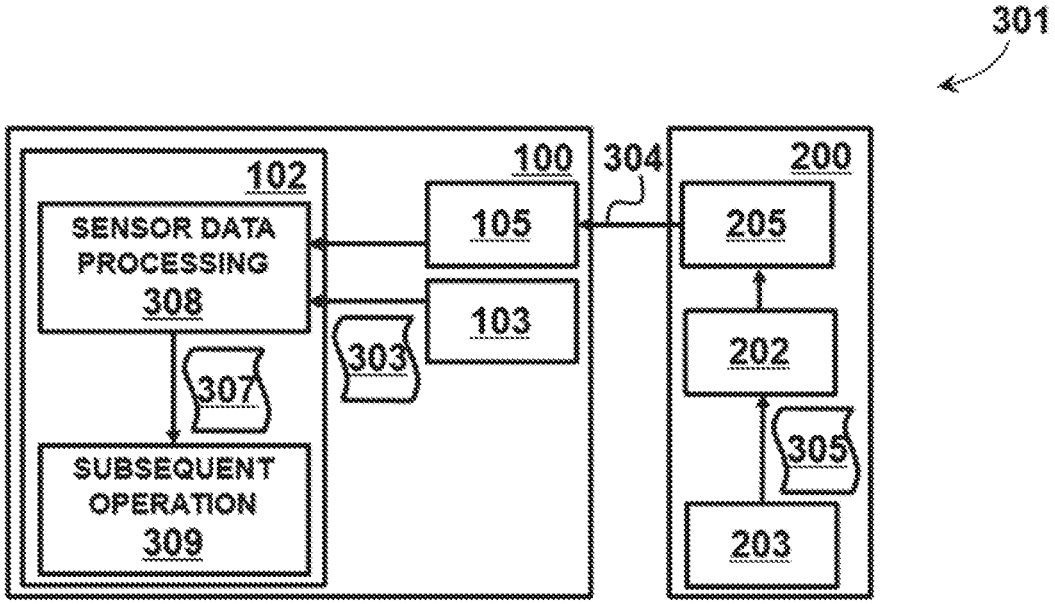
FIGS. 6-10 schematically illustrate functional block diagrams of exemplary communication systems comprising a hearing device and a remote device.

FIG. 6 illustrates a functional block diagram of a communication system 301 comprising hearing device 100 and remote device 200, in accordance with some embodiments of the present disclosure. Communication system 301 is configured for data communication between hearing device 100 and remote device 200. As depicted in the block diagram, remote data 305 is provided by sensor unit 203 of remote device 200. Processing unit 202 controls communication unit 205 of remote device 200 to transmit remote data 305 to communication unit 105 of hearing device 100 via a communication link 304. Processing unit 102 of hearing device 102 accesses remote data 305 received by communication unit 105. In parallel, processing unit 102 accesses sensor data 303 provided by sensor unit 103 of hearing device 102.

Processing unit 102 is configured to process sensor data 303 and remote data 305. To this end, processing unit 102 may execute a sensor data processing program 308. By the data processing, output data 307 is provided. Output data 307 is then employed in a subsequent operation 309 executed by processing unit 102. Subsequent operation 309 may comprise a further processing of output data 307, for instance an evaluation of output data 307 in conjunction with other data. Subsequent operation 309 may also comprise controlling an operation of hearing device 100 and/or remote device 200 depending on output data 307, for instance an operation controlling the data communication between communication unit 105 and communication unit 205 and/or an operation controlling sensor unit 103 to provide additional and/or different sensor data and/or an operation controlling a processing of audio data and/or an operation controlling a signal output of output transducer 107 such as, for instance, a volume level and/or frequency content of the output data. Subsequent operation 309 may also comprise outputting output data 307, for instance to another component of hearing device 100 and/or to an external device. For example, output data 307 may be output on a display such that it can be recognized by the user.

Figure 7:
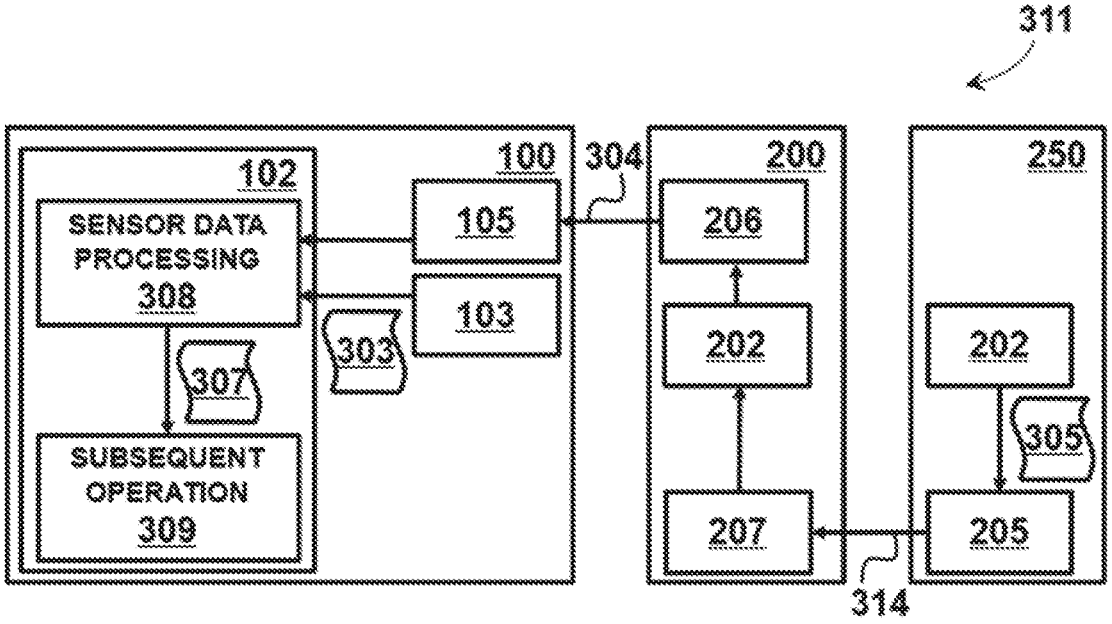

FIG. 7 illustrates a functional block diagram of a communication system 311 comprising hearing device 100, remote device 200 as a first remote device, and a second remote device 250, in accordance with some embodiments of the present disclosure. Communication system 311 can thus be provided as a communication network comprising hearing device 100, and at least two remote devices 200, 250. As shown, processing unit 202 of second remote device 250 controls communication unit 205 of second remote device 250 to transmit remote data 305 to second communication port 207 of communication unit 205 of first remote device 200 via a second communication link 314. Processing unit 202 of first remote device 200 then controls first communication port 206 of its communication unit 205 to transmit remote data 305 to communication unit 105 of hearing device 100 via first communication link 304. In this way, remote data 305 can be provided to processing unit 102 of hearing device 100 from second remote device 250 via first remote device 200. In some implementations, remote data 305 can be provided to processing unit 102 of hearing device 100 from sensor unit 203 of first remote device 200, as illustrated in FIG. 6, and from second remote device 250, as illustrated in FIG. 7.

Figure 8:
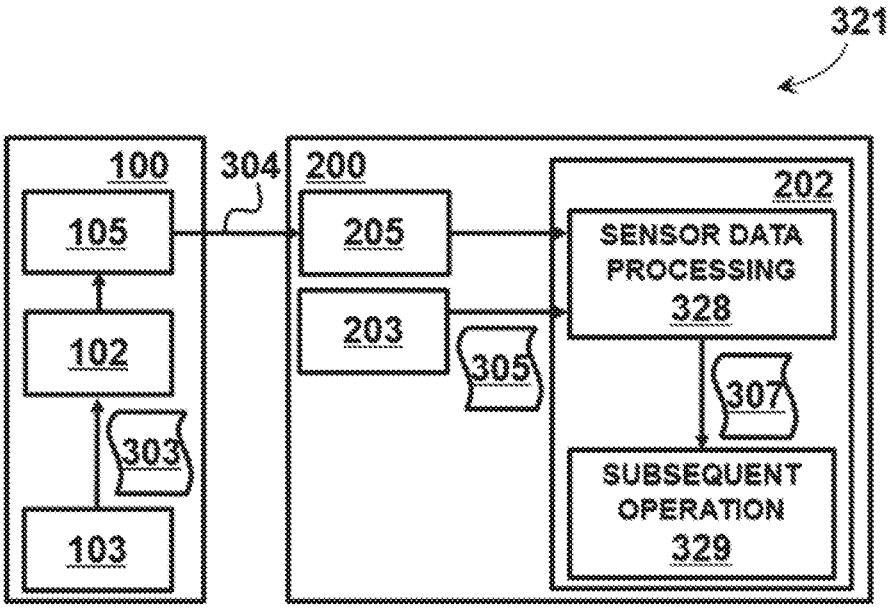

FIG. 8 illustrates a functional block diagram of a communication system 321 comprising hearing device 100 and remote device 200, in accordance with some embodiments of the present disclosure. As depicted, processing unit 102 of hearing device 100 controls communication unit 205 of hearing device 100 to transmit sensor data 303 provided by sensor unit 103 to communication unit 205 of remote device 200. Processing unit 202 of remote device 200 accesses sensor data 303 received by communication unit 205. In parallel, processing unit 202 accesses remote data 305 provided by sensor unit 203 of remote device 200. Processing unit 202 is configured to process sensor data 303 and remote data 305, in particular by executing a sensor data processing program 328. By the data processing, output data 307 is provided. Output data 307 is then employed in a subsequent operation 329 executed by processing unit 202 of remote device 200. Subsequent operation 329 may comprise a further processing of output data 307 and/or controlling an operation of hearing device 100 and/or remote device 200 depending on output data 307 and/or outputting output data 307, for instance to another component of remote device 200 and/or to an external device.

Figure 9:
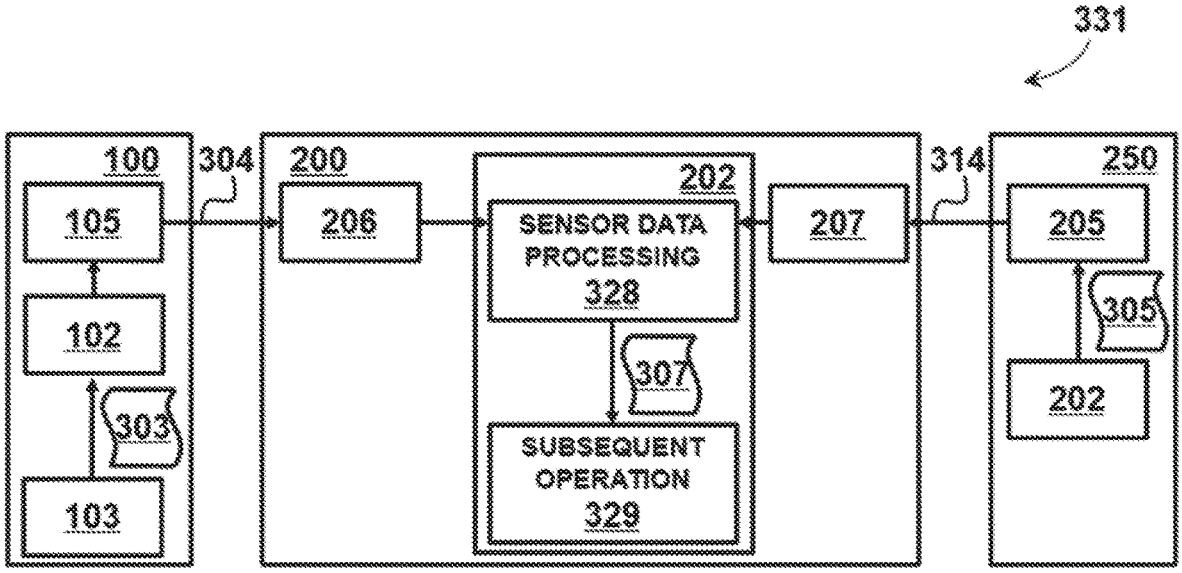

FIG. 9 illustrates a functional block diagram of a communication system 331 comprising hearing device 100, first remote device 200, and second remote device 250, in accordance with some embodiments of the present disclosure. In this way, communication system 331 can be provided as a communication network comprising hearing device 100, and at least two remote devices 200, 250. As illustrated, processing unit 202 of second remote device 250 controls communication unit 205 of second remote device 250 to transmit remote data 305 to second communication port 207 of communication unit 205 of first remote device 200 via second communication link 314. Processing unit 202 of first remote device 200 accesses sensor data 303 received by second communication port 207. In parallel, sensor data 303 is transmitted from communication unit 205 of hearing device 100 to first communication port 207 of first remote device 200 via first communication link 304 and accessed by processing unit 202 of first remote device 200. In some implementations, remote data 305 can be provided to processing unit 202 of first remote device 200 from sensor unit 203 of first remote device 200, as illustrated in FIG. 8, and from second remote device 250, as illustrated in FIG. 9.

Figure 10:
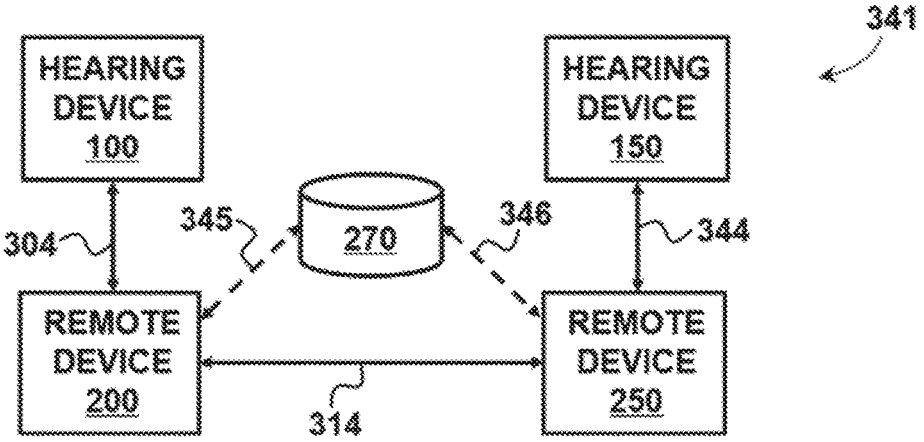

FIG. 10 illustrates a functional block diagram of a communication system 341, in accordance with some embodiments of the present disclosure. Communication system 341 is a communication network comprising hearing device 100 as a first hearing device, a second hearing device 150, first remote device 200, and second remote device 250. Second hearing device 150 may be configured corresponding to first hearing device 100 described above in that it comprises a sensor unit configured to provide sensor data and a communication unit configured for data communication. From the viewpoint of first hearing device 100, second hearing device 150 may be a third remote device and the sensor data provided by second hearing device 150 may be comprised in remote data 305. From the viewpoint of second hearing device 150, first hearing device 100 may be a third remote device and the sensor data provided by first hearing device 100 may be comprised in remote data 305.

First hearing device 100 and first remote device 200 are configured to mutually communicate sensor data 303 and/or remote data 305 via first communication link 304. First remote device 100 and second remote device 200 are configured to mutually communicate sensor data 303 and/or remote data 305 via second communication link 314. Second hearing device 150 and second remote device 250 are configured to mutually communicate sensor data 303 and/or remote data 305 via a third communication link 344. Communication system 341 further may comprise a server 270. First remote device 100 and second remote device 200 may be configured for data communication with server 270 via a respective communication link 345, 346. In this way, first remote device 100 and second remote device 200 can also be configured to mutually communicate sensor data 303 and/or remote data 305 via server 270. In some implementations, first remote device 100 and second hearing device 150 are configured to mutually communicate sensor data 303 and/or remote data 305 via a respective communication link. In some implementations, first hearing device 100 and second hearing device 150 are configured to mutually communicate sensor data 303 and/or remote data 305 via a respective communication link. In some implementations, first hearing device 100 and second hearing device 150 are configured to mutually communicate sensor data 303 and/or remote data 305 via server 270.

Figure 11:
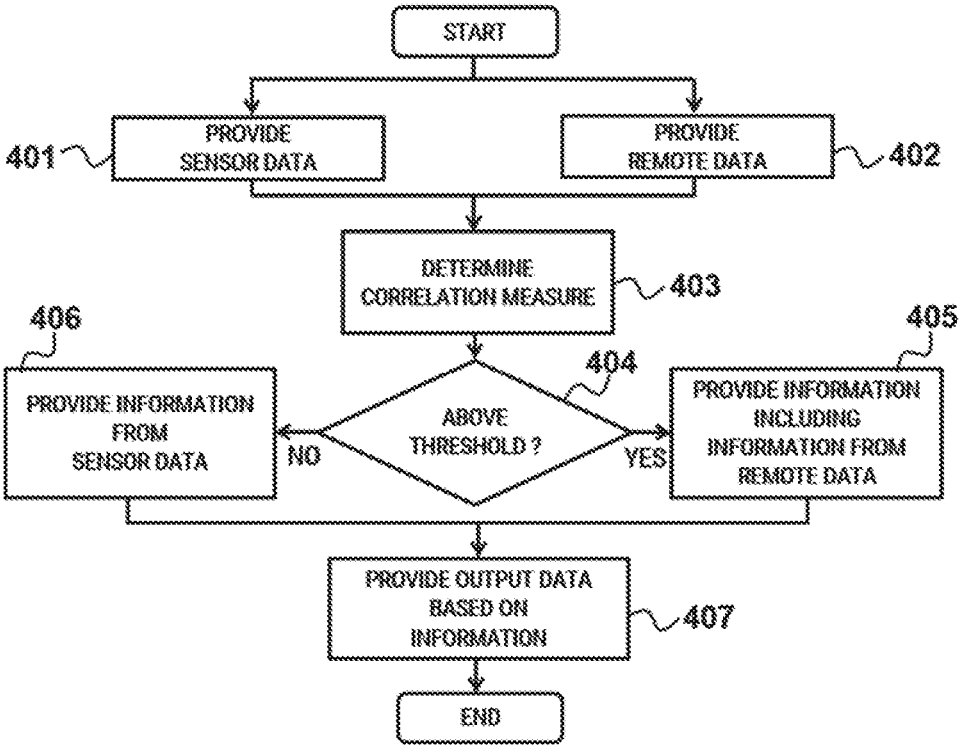
FIGS. 11-21 illustrate exemplary methods of operating a hearing device and/or a communication system.

FIG. 11 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328. In operation 401, sensor data is provided. In parallel, in operation 402, remote data is provided. The sensor data may be sensor data 303 provided from sensor unit 103 of hearing device 100. The remote data may be remote data 305 provided from remote device 200.

In operation 403, a correlation measure between the sensor data and the remote data is determined. As used herein, a "correlation measure" may include any indicator of a degree of correlation between information in the sensor data and information in the remote data relative to a threshold. For example, the correlation measure may be a similarity measure indicating a similarity between the sensor data and the remote data. The correlation measure may be a correlation coefficient indicating a relationship, particular a statistical relationship, between the sensor data and the remote data. The threshold can be a threshold of the correlation, in particular a similarity threshold and/or a threshold of the relationship between the sensor data and the remote data.

In operation 404, an operation 405, 406 is selected depending on the correlation measure, this is depending on the degree of correlation between information in the sensor data and information in the remote data relative to the threshold. The operation is selected from a first operation 405, in which information for output data is provided based on information including information in the remote data, wherein information in the sensor data may also be included, and a second operation 406, in which information for output data is provided based on information in the sensor data, such that information in the remote data is disregarded. The information in the sensor data and/or the information in the remote data on which the output data is based may be extracted from the sensor data and/or remote data provided in operations 401, 402 based on which the degree of correlation between information in the sensor data and information in the remote data is determined in operation 403, or the information in the sensor data and/or the information in the remote data on which the output data is based may be extracted from different sensor data and/or different remote data, in particular from sensor data and/or remote data provided at a different time. For instance, the output data may be based on information in sensor data and/or information in remote data which sensor data and/or remote data is provided after the correlation measure has been determined in operation 403.

According to operation 404, first operation 405 is selected when the degree of correlation between information in the sensor data and information in the remote data is above the threshold. Second operation 406 is selected when the degree of correlation between information in the sensor data and information in the remote data is below the threshold. Thus, when the correlation measure is above the threshold, the output data is based on information including information in the remote data, wherein information in the sensor data may also be included. When the correlation measure is below the threshold, the output data is based on information in the sensor data, wherein information in the remote data is disregarded. This may be exploited, for instance, to improve a quality of the output data relative to the sensor data by employing information from the remote data when the correlation measure relative to the threshold indicates that such an improvement can be achieved. The threshold of the correlation measure may be used as a quality criterion which the remote data must match during determining the degree of correlation with the sensor data in operation 403 to be considered for the generation of the output data in operation 405. In a case in which the degree of correlation falls below the quality criterion as determined by the threshold of the correlation measure, the remote data may not be useful for the generation of the output data such that the remote data can be disregarded in operation 406 and the output data provided in operation 407 is based on information from the sensor data.

In operation 407, the output data is provided based on the information provided in first operation 405, or the information provided in second operation 406.

Figure 12:
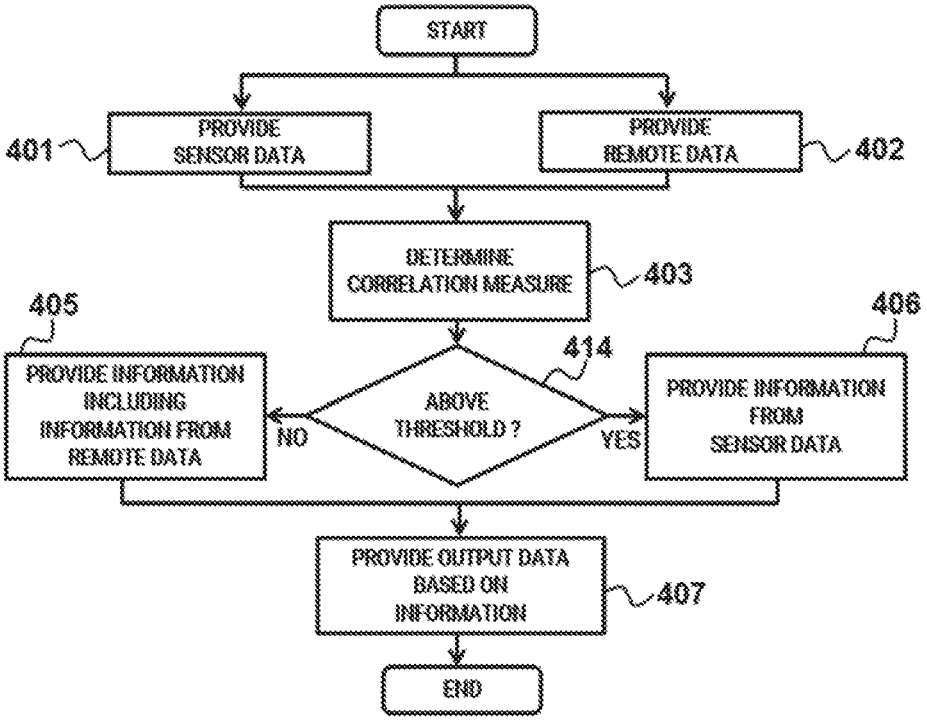

FIG. 12 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

In operation 414, which may be performed in place of operation 404 of the method illustrated in FIG. 11, first operation 405 is selected when the degree of correlation between information in the sensor data and information in the remote data is below the threshold. Second operation 406 is selected when the degree of correlation between information in the sensor data and information in the remote data is above the threshold. Thus, when the correlation measure is below the threshold, the output data is based on information including information in the remote data, wherein information in the sensor data may also be included. When the correlation measure is above the threshold, the output data is based on information in the sensor data, wherein information in the remote data is disregarded.

In this way, for instance, a quality of the output data may be improved relative to the sensor data by employing information from the remote data when the correlation measure relative to the threshold indicates that such an improvement is required, in particular when the remote data contains information that can improve the sensor data. The threshold of the correlation measure may be used as a quality criterion which the sensor data must fail to comply with during determining the degree of correlation with the remote data in operation 403 such that the remote data will be considered for the generation of the output data in operation 405. In a case in which the degree of correlation meets and/or exceeds the quality criterion as determined by the threshold of the correlation measure, the remote data may not be required to be considered for the generation of the output data such that the remote data can be disregarded in operation 406 and the output data provided in operation 407 is based on information from the sensor data.

Figure 13:
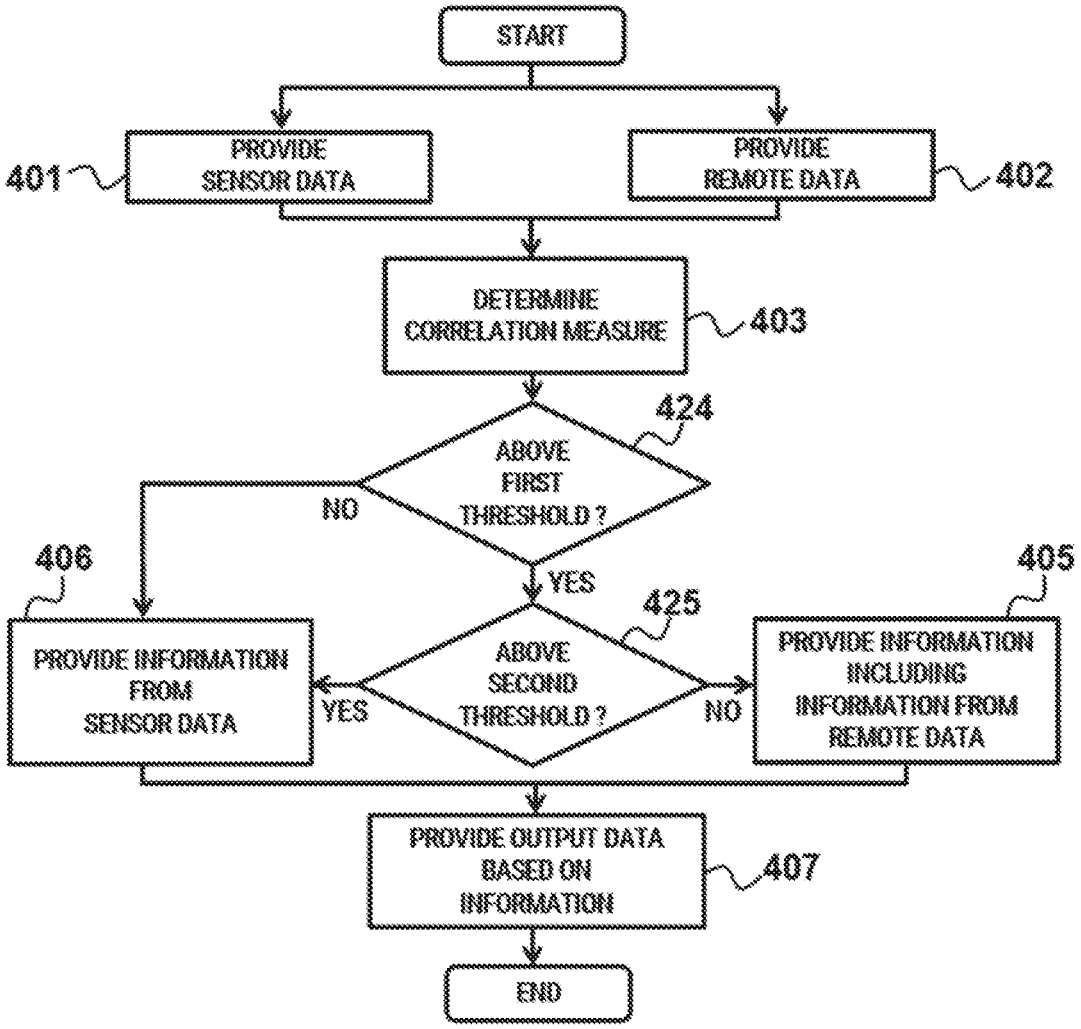

FIG. 13 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

In operation 424, second operation 406 is selected when the degree of correlation between information in the sensor data and information in the remote data is below a first threshold. When the degree of correlation is above the first threshold, first operation 405 is selected in operation 425 when the degree of correlation between information in the sensor data and information in the remote data is below a second threshold. When the degree of correlation between information in the sensor data and information in the remote data is above the second threshold, second operation 406 is selected in operation 425. Operations 424, 425 may be performed in place of operation 404 or operation 414 of the methods illustrated in FIGS. 11, 12. Thus, when the correlation measure is below the first threshold, the output data is based on information in the sensor data, wherein information in the remote data is disregarded. When the correlation measure is above the first threshold and below the second threshold, the output data is based on information including information in the remote data, wherein information in the sensor data may also be included. When the correlation measure is above the second threshold, the output data is based on information in the sensor data, wherein information in the remote data is disregarded.

Thus, advantages of the methods illustrated in FIGS. 11, 12 may be combined. For instance, in a case in which the degree of correlation falls below the quality criterion as determined by the first threshold of the correlation measure, the remote data may not be considered to be useful for the generation of the output data such that the remote data can be disregarded in operation 406 and the output data provided in operation 407 is based on information from the sensor data. In a case in which the degree of correlation meets or exceeds the quality criterion as determined by the first threshold of the correlation measure, but the degree of correlation falls short of the quality criterion as determined by the second threshold of the correlation measure, the remote data is considered for the generation of the output data in operation 405 to improve the output data relative to the sensor data. In a case in which the degree of correlation meets or exceeds the quality criterion as determined by the second threshold of the correlation measure, the remote data may also not be useful for the generation of the output data, since it may not represent a significant improvement of the information in the sensor data, such that the remote data can be disregarded in operation 406 and the output data provided in operation 407 is based on information from the sensor data.

Figure 14:
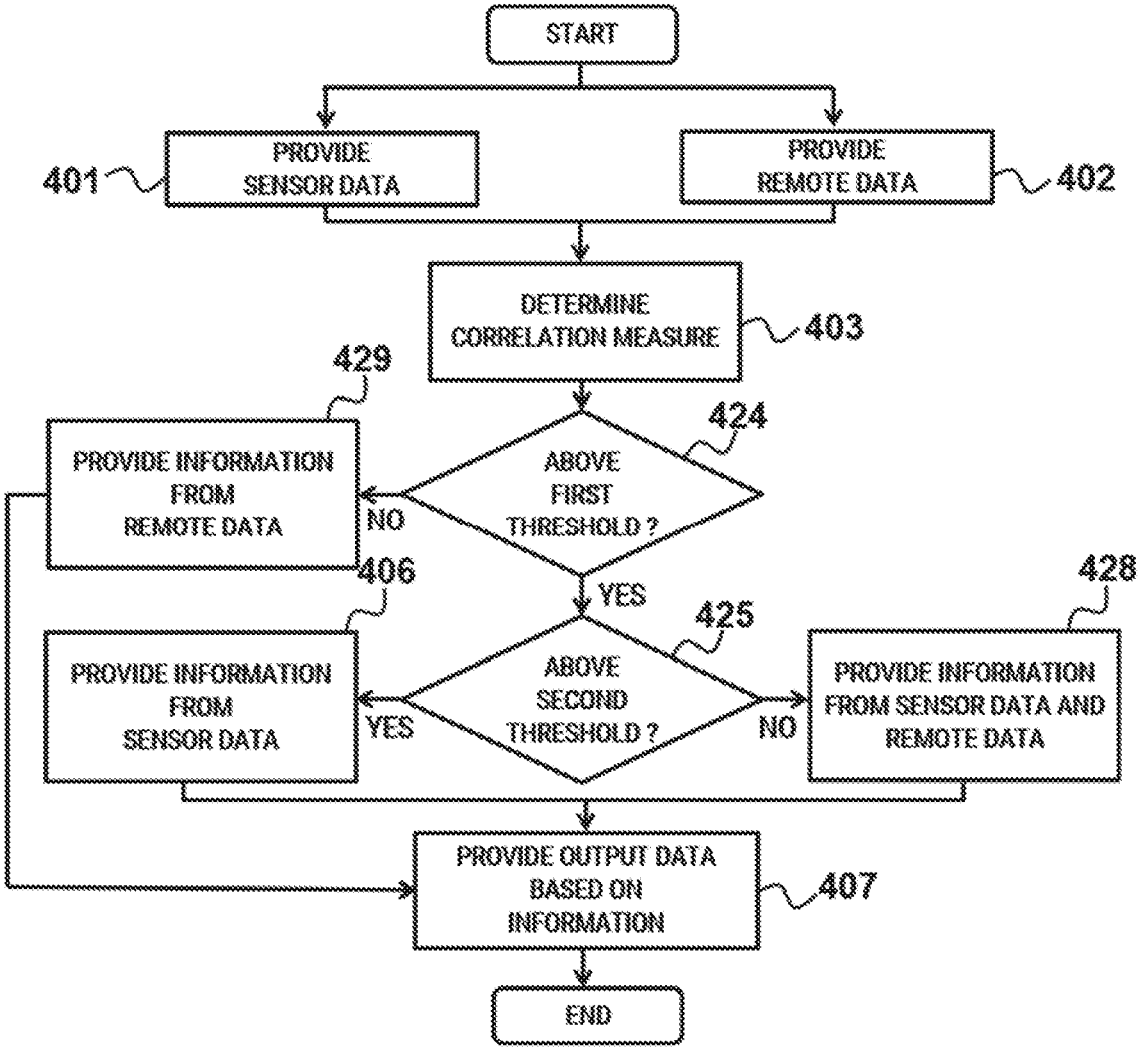

FIG. 14 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328. The method may be implemented to determine a correlation measure between sensor data and remote data relative to a threshold, in particular in the place of operation 403 for determining a correlation measure in any of the methods illustrated in FIGS. 11, 12, and 13.

First operation 405, in which information for output data is provided based on information including information in the remote data, can be selected from a third operation 428 and a fourth operation 429. In third operation 428, the output data is based on information including information in the sensor data and information in the remote data. In fourth operation 429, the output data is based on information in the remote data such that information in the sensor data is disregarded in the output data. Third operation 428 is selected in operation 424 when the degree of correlation between information in the sensor data and information in the remote data is below a first threshold. When the degree of correlation is above the first threshold, fourth operation 428 is selected in operation 425 when the degree of correlation between information in the sensor data and information in the remote data is below a second threshold. When the degree of correlation between information in the sensor data and information in the remote data is above the second threshold, second operation 406 is selected in operation 425. Operations 424, 425 may be performed in place of operation 404 or operation 414 of the methods illustrated in FIGS. 11, 12. Thus, when the correlation measure is below the first threshold, the output data is based on information in the remote data, wherein information in the sensor data is disregarded. When the correlation measure is above the first threshold and below the second threshold, the output data is based on information including information in the remote data and information in the sensor data. When the correlation measure is above the second threshold, the output data is based on information in the sensor data, wherein information in the remote data is disregarded. In this way, when the degree of correlation is below the first threshold, a better reliability of the remote data as compared to the sensor data may be exploited.

Figure 15:
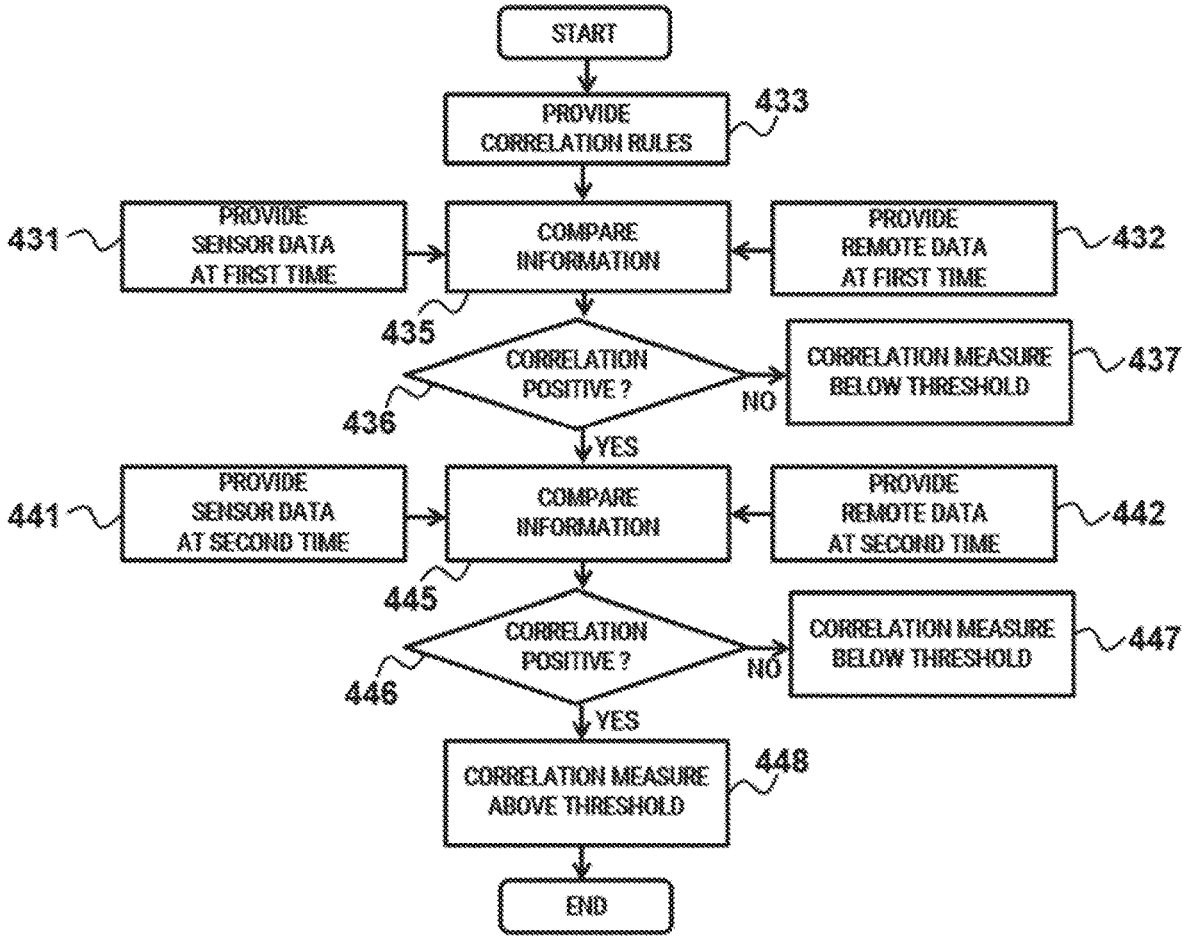

FIG. 15 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328. The method may be implemented to determine a correlation measure between sensor data and remote data relative to a threshold, in particular in the place of operation 403 for determining a correlation measure in any of the methods illustrated in FIGS. 11, 12, 13 and 14.

In operation 431, sensor data is provided. In parallel, in operation 402, remote data is provided. Sensor data 303 may be provided from sensor unit 103 of hearing device 100. Remote data 305 may be provided from remote device 200. In operation 435, information in the sensor data and information in the remote data is compared with respect to a degree of correlation between the information in the sensor data and the information in the remote data. The comparison is based on correlation rules provided in a preceding operation 433. The correlation rules can quantify a degree of correlation between information in the sensor data and information in the remote data. The correlation rules may also quantify at least one threshold for the degree of correlation between information in the sensor data and information in the remote data. The correlation rules may also specify a type of information in the sensor data and a type of information in the remote data for which the degree of correlation relative to the threshold may be determined. The correlation rules may thus be employed in a procedure of obtaining the correlation measure between the sensor data and the remote data.

The correlation rules provided in operation 433 may be based on a previously known mapping relation between information in the sensor data, information in the remote data, and a degree of correlation between the information in the sensor data and the information in the remote data. The mapping relation may be derived from a mathematical and/or observable and/or computable relationship between information in the sensor data and in the remote data. The mapping relation may be predetermined by sensor data processing program 308 and/or sensor data processing program 328. By the mapping relation, information in the sensor data and associated information in the remote data can be mapped to the correlation measure. Thus, in a comparison between the information in the sensor data and the information in the remote data, the remote data may be found to represent correlated information of the sensor data to a degree of correlation as defined by the mapping relation. The degree of correlation can then be evaluated relative to a threshold. The correlation measure may be determined to be above the threshold, when the degree of correlation equals and/or exceeds the threshold. Or, the correlation measure may be determined to be below the threshold, when the degree of correlation falls below the threshold. For instance, the correlation rules may be provided in operation 433 by a dependence of the correlation measure as a function of information in the sensor data and information in the remote data. The correlation rules provided in operation 433, in particular the mapping relation to the correlation measure, may also be provided by a trained machine learning algorithm, as will become apparent in the description that follows.

In some implementations, information about a dependency of the degree of correlation from the threshold may be included in the correlation measure. Thus, an evaluation of the degree of correlation relative to the threshold may be apparent from the degree of correlation after it has been determined, as for instance in a comparison between the information in the sensor data and in the remote data. To illustrate, the degree of correlation may be provided by a pair of values, for instance binary values such as zero and one, wherein one of the values indicates a degree of correlation below the threshold, and the other of the values indicates a degree of correlation above the threshold. In some implementations, information about a dependency of the degree of correlation from the threshold may not be included in the correlation measure such that a value of the threshold may be provided in a subsequent evaluation of the degree of correlation relative to the threshold. To illustrate, the degree of correlation may be provided as a numeric value on a discrete or continuous scale and the threshold may also be provided as a numeric value on that scale.

In operation 436, the comparison between the information in the sensor data and in the remote data provided in operations 431, 432 with respect to their degree of correlation relative to the threshold is evaluated. In case of a negative outcome of the evaluation, the degree of correlation between the information provided in operations 431, 432 is determined to be below the threshold. As a consequence, the correlation measure of information in the sensor data and in the remote data is determined to be below the threshold in operation 437.

In case of a positive outcome of the comparison, a second comparison is performed in operation 445, in addition to the first comparison in operation 435. To this end, sensor data is provided at a second time in operation 441, in addition to the sensor data provided at the first time in operation 431. Moreover, remote data is provided at a second time in operation 442, in addition to the remote data provided at the first time in operation 432. In operation 445, information in the sensor data and information in the remote data provided at the second time is compared with respect to a degree of correlation between the information in the sensor data and the information in the remote data. The second comparison can be based on the same correlation rules as the first comparison. The sensor data provided in operation 441 can be provided by sensor unit 103 of hearing device 100 later than the sensor data provided in operation 431. The remote data provided in operation 442 can be provided by remote device 200 later than the remote data provided in operation 432. In this way, the sensor data and the remote data can be compared at different times in operation 435 and in operation 445.

The second comparison is evaluated in operation 446. In case of a negative outcome of the evaluation, the degree of correlation for the information provided at the second time in operations 441, 442 is determined to be below the threshold. As a consequence, a resulting correlation measure of information in the sensor data and in the remote data provided at the different times, including at the first time in operations 431, 432 and at the second time in operations 441, 442, is determined to be below the threshold in operation 447.

The procedure, as defined by operations 431, 432, 435, 436, 437 for the first time and by operations 441, 442, 445, 446, 447 for the second time, may be repeated for an additional number of times. This may include providing sensor data and remote data at the additional number of times, and performing an additional number of comparisons between the sensor data and the remote data at the different times. In case of a positive outcome of the comparisons evaluated at the different times, a resulting degree of correlation of the information in the sensor data and in the remote data is determined to be above the threshold in operation 448.

In this way, a resulting correlation measure can be determined for the sensor data and the remote data after providing the sensor data and the remote data at different times and determining the degree of correlation of information in the sensor data and in the remote data relative to the threshold at the different times. Thus, a reliability of the correlation measure can be enhanced, since the resulting determination of the degree of correlation can be based on a plurality of different times at which the sensor data and the remote data is provided, such that a false assessment at one of those times may be compensated.

Figure 16:
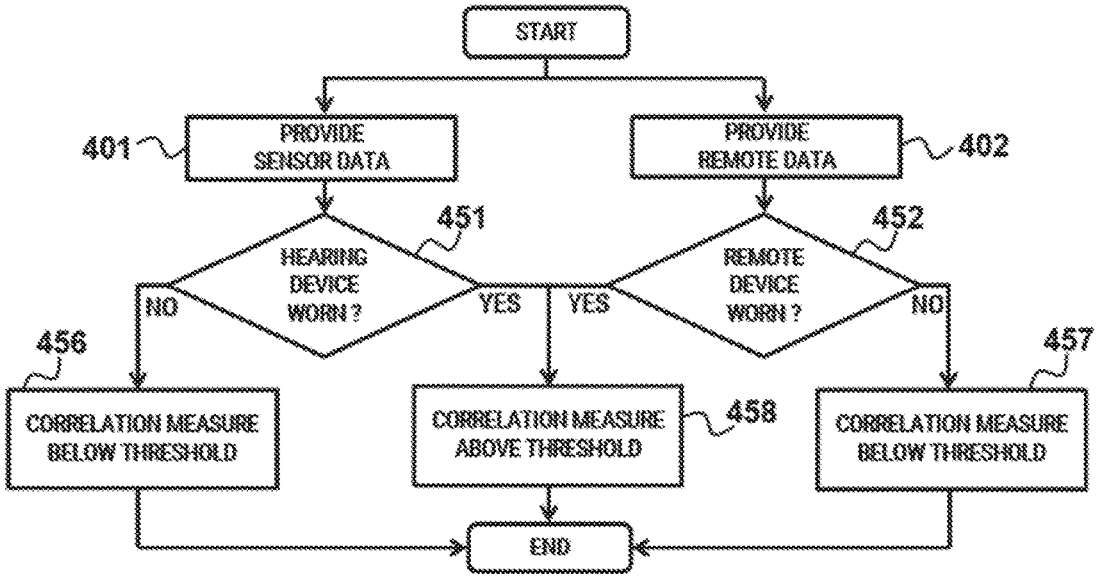

FIG. 16 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328. The method may be implemented to determine a correlation measure between sensor data and remote data relative to a threshold, in particular in the place of operation 403 for determining a correlation measure in any of the methods illustrated in FIGS. 11, 12, and 13.

In operation 451, the sensor data provided in operation 401 is evaluated whether the hearing device is worn at an ear of a user. The evaluation may also be based on sensor data provided at different times, for instance corresponding to operations 431, 441. The information in the sensor data employed for the evaluation may comprise, for instance, pressure sensor data indicating a contact of the ear device with the ear and/or acoustical feedback data depending on an insertion of the hearing device into the ear canal and/or own voice data and/or bone conduction signal data and/or health monitoring data and/or temperature data and/or user interaction data. In a case in which the evaluation leads to a conclusion that the hearing device is not worn at an ear of a user, a degree of correlation between information in the sensor data and information in the remote data is determined to be below a threshold in operation 456.

In parallel, in operation 452, the remote data provided in operation 402 is evaluated whether the remote device is worn by the user. The evaluation may also be based on remote data provided at different times, for instance corresponding to operations 432, 442. The time at which the remote data is provided may correspond to the time at which the sensor data is provided. The information in the remote data employed for the evaluation may comprise, for instance, a log-in status of the user into an operation system of the remote device and/or movement data and/or user interaction data. In a case in which the evaluation leads to a conclusion that the remote device is not worn by the user, a degree of correlation between information in the sensor data and information in the remote data is determined to be below the threshold in operation 457. In a case in which the evaluation in operation 451 leads to a conclusion that the hearing device is worn at an ear of a user, and the evaluation in operation 452 leads to a conclusion that the remote device is worn by the user, a degree of correlation between information in the sensor data and information in the remote data is determined to be above the threshold in operation 458.

In this way, a correlation measure between the sensor data and the remote data may be used as an indicator whether the sensor data comprises information that the hearing device is worn at an ear of a user, and whether the remote data comprises information that the remote device is worn by the user. The correlation measure can be determined to be above threshold when the hearing device is worn at an ear of a user and the remote device is also worn by the user. The correlation measure can be determined to be below threshold when the hearing device is not worn at an ear of a user and/or the remote device is not worn by the user. When the correlation measure is above threshold, it can be assumed that information in the sensor data and information in the remote data may be redundant, related, and/or complementary due to the circumstance that the user is wearing both devices. Thus, when output data is provided according to operations 405, 407 described above, the information in the remote data may be employed for a compensation of missing information in the sensor data and/or as a substitute or verification for redundant information in the sensor data and/or for an augmentation of the sensor data by complementary information.

To illustrate, the sensor data may comprise information about a heartrate of a user wearing the hearing device, and the remote data may comprise information about a movement of a user wearing the remote device. When the correlation measure is above threshold, it can be assumed that both the hearing device and the remote device are worn by the user. The output data provided in operation 407 is then at least based on information from the remote data according to operation 405, and may also be based on information from the sensor data. When the sensor data indicates an increasing heartrate, and the remote data indicates a movement activity of the user, the output data may be based on both the information in the sensor data and the information in the remote data and thus may indicate that the user is involved in a physical activity. When the sensor data indicates an increasing heartrate, and the remote data indicates no movement activity of the user, the output data may be again based on both the information in the sensor data and the information in the remote data and thus may indicate that the user is involved in a stressful situation and/or carries a health risk.

Figure 17:
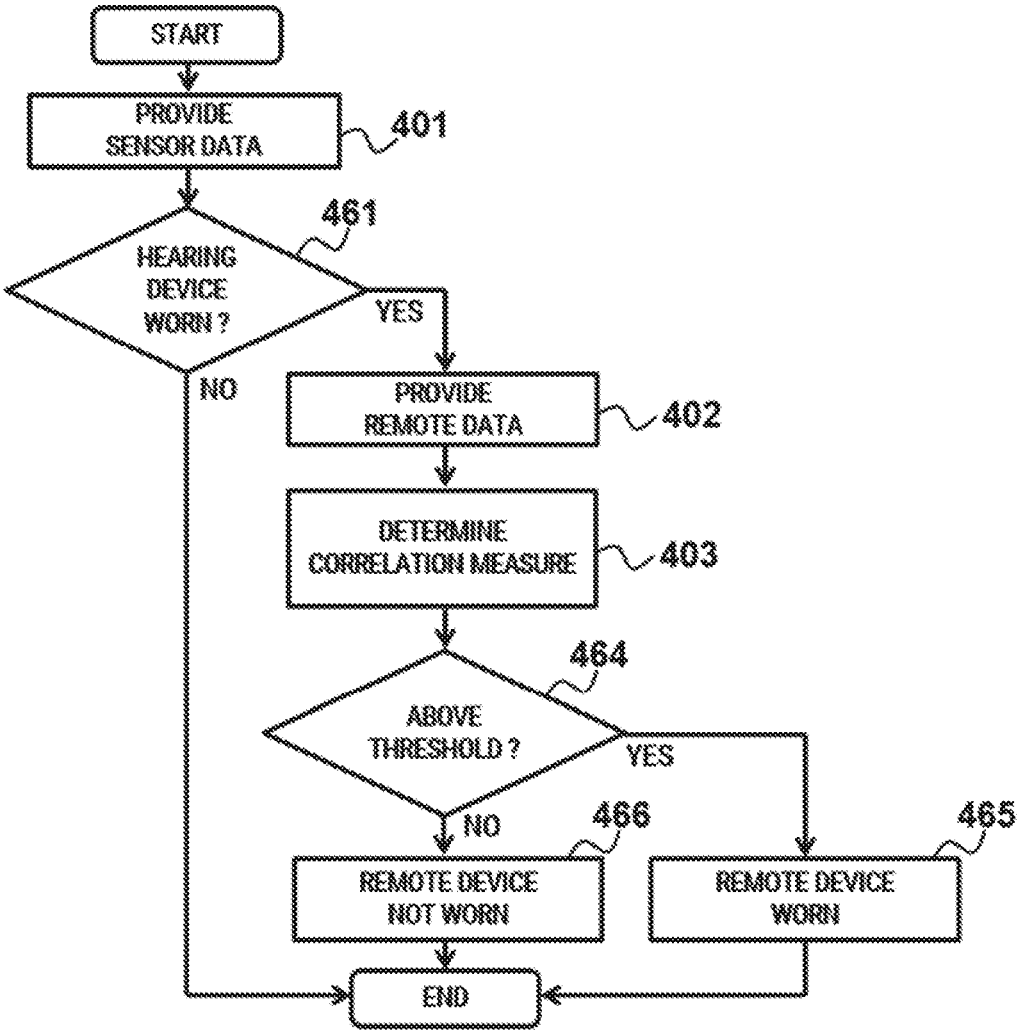

FIG. 17 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

In operation 461, the sensor data provided in operation 401 is evaluated whether the hearing device is worn at an ear of a user. The evaluation can be performed corresponding to operation 451 described above. When the evaluation yields that the hearing device is worn at the user's ear, operation 402 of providing remote data, and operation 403 of determining a degree of correlation between information in the sensor data and information in the remote data are performed.

For example, the sensor data may comprise information indicating that the hearing device is worn at the user's ear, as determined in operation 461, and the remote data may comprise proximity data relative to the hearing device. The proximity data may be obtained by a proximity sensor, as described above. When the proximity data indicates that the remote device is close enough to the hearing device, and the sensor data indicates that the hearing device is worn at the user's ear, as determined in operation 461, the degree of correlation between information in the sensor data and information in the remote data can be determined to be above the threshold. When the proximity data indicates that the remote device is further away from the hearing device, irrespective whether the sensor data indicates that the hearing device is worn at the user's ear, as determined in operation 461, the degree of correlation between information in the sensor data and information in the remote data can be determined to be below the threshold. The threshold of the correlation measure may thus be defined by a threshold distance between the remote device and the hearing device, as indicated by the information in the remote data, and by the additional circumstance whether the hearing device is worn at the user's ear, as indicated by the information in the sensor data.

As another example, the sensor data may comprise the information indicating that the hearing device is worn at the user's ear, as determined in operation 461, and additional information comprising audio data and/or movement data recorded in an environment of the hearing device. Furthermore, the remote data may contain information comprising audio data and/or movement data recorded in an environment of the remote device. The degree of correlation between the sensor data and the remote data may then be based on the information in the sensor data whether the hearing device is worn at the user's ear, as determined in operation 461, and in addition based on a correlation measure between the information comprising audio data and/or movement data in the sensor data and the information comprising audio data and/or movement data in the remote data. The correlation measure between the audio information and/or movement information in the sensor data and in the remote data may be determined relative to a threshold, as for instance in the method illustrated in FIG. 15. When the correlation measure between the audio information and/or movement information in the sensor data and in the remote data is above threshold, and the sensor data indicates that the hearing device is worn at the user's ear, as determined in operation 461, the degree of correlation between information in the sensor data and information in the remote data can be determined to be above the threshold. When the correlation measure between the audio information and/or movement information in the sensor data and in the remote data is below threshold, irrespective whether the sensor data indicates that the hearing device is worn at the user's ear, as determined in operation 461, the degree of correlation between information in the sensor data and information in the remote data can be determined to be below the threshold. The threshold of the correlation measure between the information in the sensor data and the information in the remote data may thus be defined by a threshold of a correlation measure between the audio information and/or movement information in the sensor data and in the remote data, and by the additional circumstance whether the hearing device is worn at the user's ear, as indicated by the information in the sensor data.

In operation 464, an operation is selected out of two operations 465, 466 depending on the degree of correlation between information in the sensor data and information in the remote data relative to the threshold. When the degree of correlation is above threshold, operation 465 is selected in which it is determined that the remote device is worn by the user. When the degree of correlation is below threshold, operation 466 is selected in which it is determined that the remote device is not worn by the user. Subsequent to operation 465, first operation 405 may be performed, in which information for output data is provided based on information including information in the remote data, followed by operation 407 of providing the output data, as described above in conjunction with FIG. 11. In this way, the output data may be improved relative to the sensor data by the remote data when is has been determined that the remote device is worn by the user in addition to the hearing device. Subsequent to operation 466, second operation 406 may be performed, in which information for output data is provided based on information in the sensor data, followed by operation 407 of providing the output data, as also described above in conjunction with FIG. 11. Thus, the remote data may be disregarded in the output data when the remote device is not worn by the user, in order to avoid a degradation of the output data relative the sensor data by including unrelated information from remote data when the remote device not worn by the user.

Figure 18:
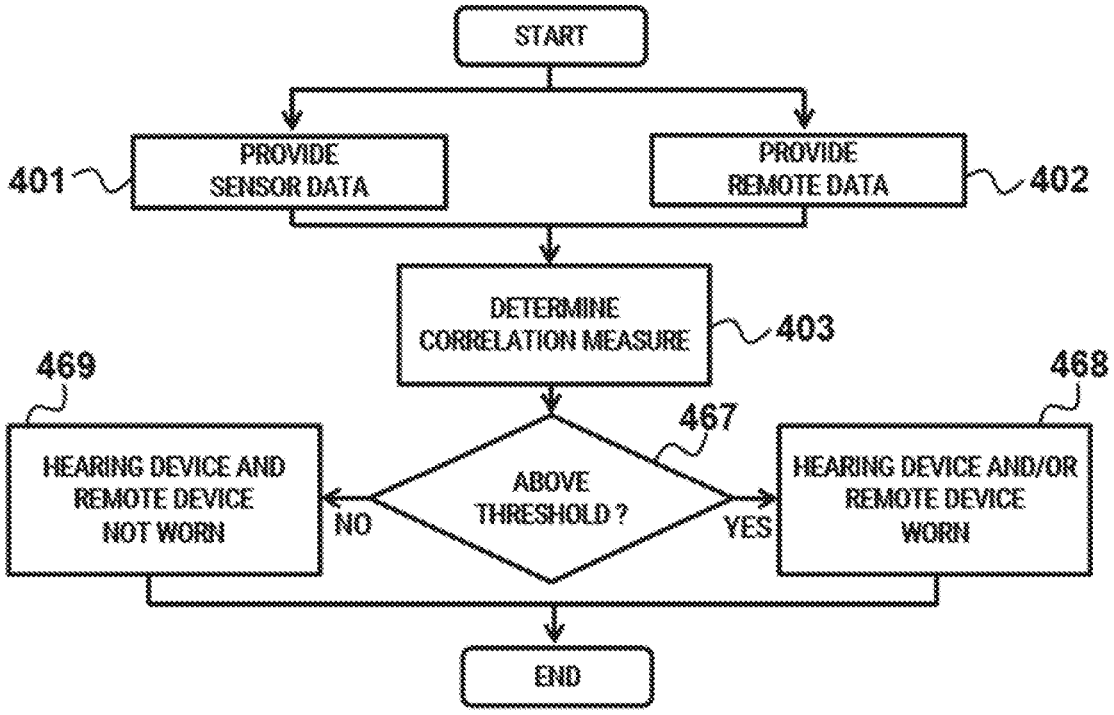

FIG. 18 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

After determining the correlation measure in operation 403 between information in the sensor data provided in operation 401 and information in the remote data provided in operation 402, the correlation measure is evaluated to be above the threshold or below the threshold in operation 467. When the correlation measure is above the threshold, the hearing device can be determined to be worn at the user's ear and the remote device can also be determined to be worn by the user in operation 468. Subsequent to operation 468, first operation 405 may be performed, in which information for output data is provided based on information including information in the remote data, followed by operation 407 of providing the output data, as described in conjunction with FIG. 11. When the correlation measure is below the threshold, it can be determined that at least one of the hearing device and the remote device is not worn by the user in operation 469. Subsequent to operation 469, second operation 406 may be performed, in which information for output data is provided based on information in the sensor data, followed by operation 407 of providing the output data, as illustrated in FIG. 11.

For example, the sensor data may comprise connection data, as provided in operation 401, and the remote data may comprise location data, as provided in operation 402. The correlation measure in operation 403 may be determined by a comparison of information in the connection data and information in the location data at different times, as illustrated in FIG. 15. When the connection data indicates that the remote device remains connected with the hearing device over time and the location data indicates a change of the location during the same time, the correlation measure can be determined to be above the threshold in operation 467. In particular, under those circumstances of an established data connection during a changing location it may be assumed that the user is wearing both the hearing device and the remote device during changing his location, as determined in operation 468. When the connection data indicates that the remote device does not remain connected with the hearing device over time and/or the location data does not indicate a change of the location during the same time, the correlation measure can be determined to be below the threshold in operation 467. Under those circumstances of it may not be safely assumed that the user is wearing both the hearing device and the remote device during changing his location, as determined in operation 469.

Figure 19:
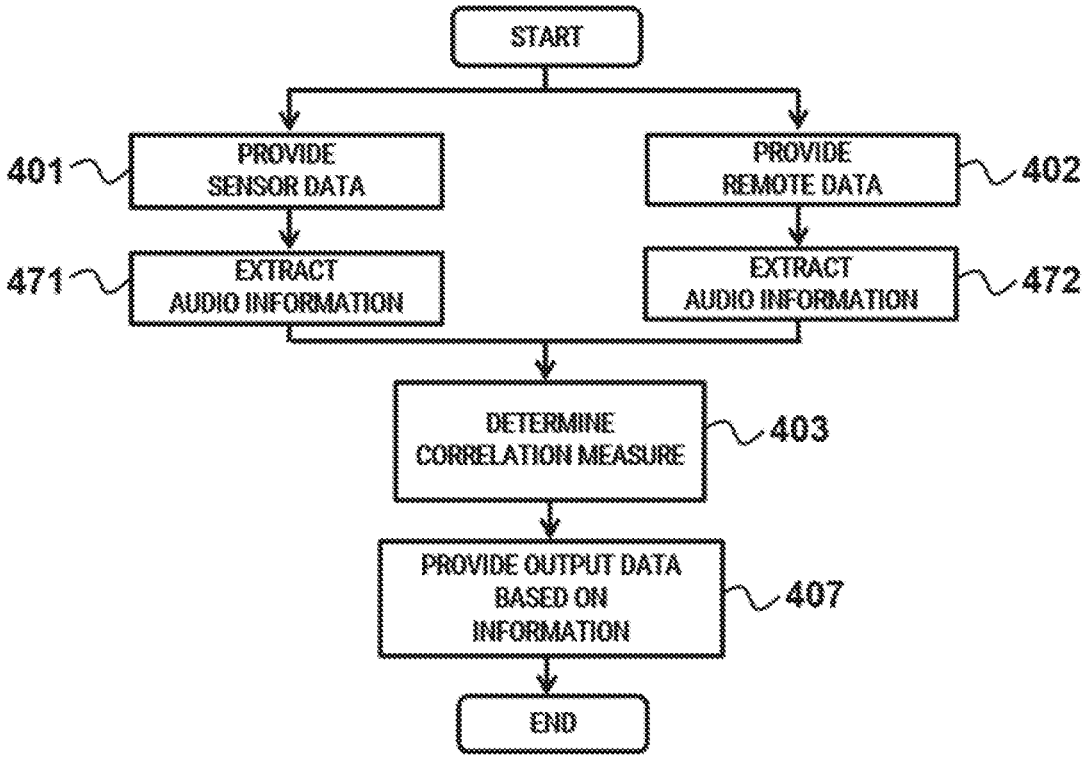

FIG. 19 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

In operation 471, audio information is extracted from the sensor data provided in operation 401. The audio information may be extracted from audio data included in the sensor data. The audio data may be provided by microphone 112 of hearing device 100. In operation 472, audio information is extracted from the remote data provided in operation 402. The audio information may be extracted from audio data included in the remote data. The audio data may be provided by a microphone included in sensor unit 203 of remote device 200. Based on the extracted audio information of the sensor data and the remote data, operation 403 of determining a correlation measure between the sensor data and the remote data, and operation 407 of providing output data based on the information are performed.

The correlation measure can be determined in operation 403 based on the audio information extracted from the sensor data and the remote data, as, for instance, in the method illustrated in FIG. 15. In some implementations, the correlation measure between the sensor data and the remote data determined in operation 403 can further comprise an indicator whether the sensor data comprises information that the hearing device is worn at an ear of a user, and whether the remote data comprises information that the remote device is worn by the user, for instance according to the method illustrated in FIG. 16. After determining the correlation measure in operation 403 relative to the threshold, an operation for providing output data can be selected depending on the correlation measure, for instance according to any of operations 404, 414, 424, 425 described above in conjunction with the methods illustrated in FIGS. 11, 12, and 13.

The operation for providing output data can thus be selected from first operation 405, in which information for the output data is based on information including information in the remote data, and second operation 406, in which information for the output data is based on information in the sensor data. Before first operation 405 or second operation 406 are performed, operations 401, 471 of providing sensor data and extracting audio information from the sensor data and/or operations 402, 472 of providing remote data and extracting audio information from the remote data may be repeated. Thus, the output data may be based on updated audio information as compared to the audio information on which the determining of the correlation measure in operation 403 has been based.

By extracting the audio information in operations 471, 472, it can be ensured that redundant and/or related information from the sensor data and the remote data is provided, based on which the correlation measure is determined in operation 403. Thus, a reliability of the correlation measure may be enhanced. Additionally or alternatively, other related information may be extracted from the sensor data and the remote data in operations 471, 472. For instance, movement information and/or proximity information and/or body information and/or temperature information and/or location information and/or altitude information may be extracted from both the sensor data and the remote data. In this way, the output data provided in operation 407 may be provided at a better accuracy as compared to the sensor data by including information from the remote data, when the correlation measure is determined to be above the threshold.

Figure 20:
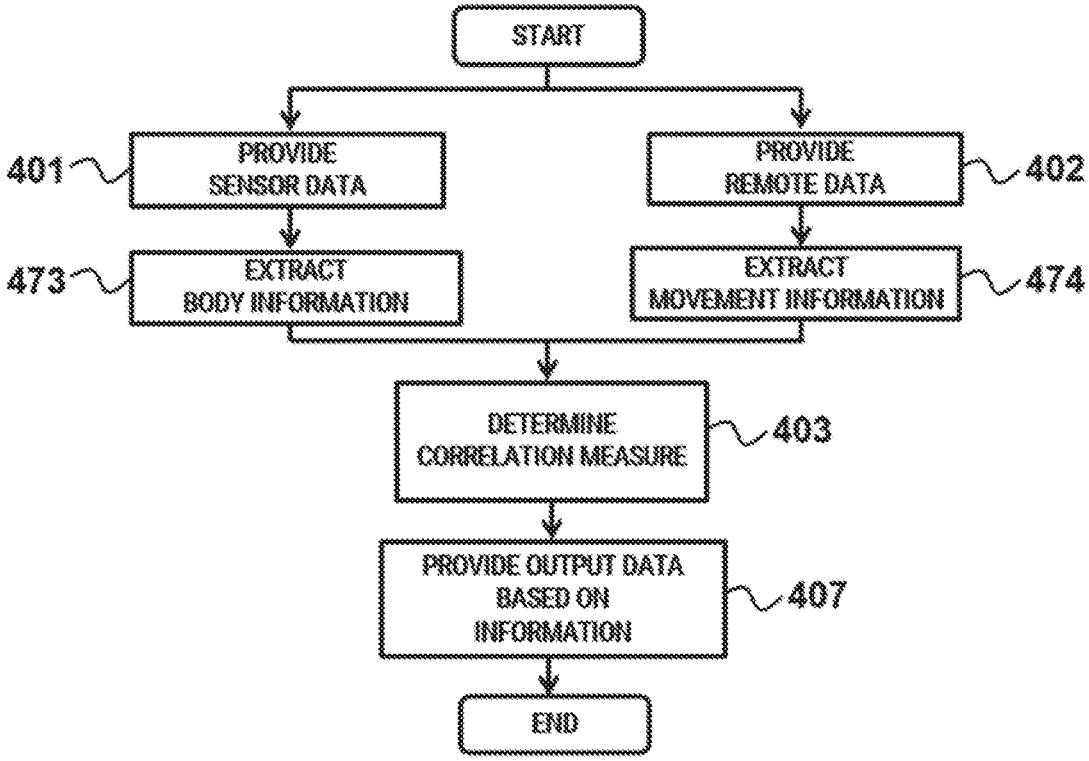

FIG. 20 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

In operation 473, body information indicative of a physical property of the user's body is extracted from the sensor data provided in operation 401. The body information may be extracted from body data included in the sensor data. The body data may be provided by body sensor 118 of hearing device 100. In operation 474, movement information is extracted from the remote data provided in operation 402. The movement information may be extracted from movement data included in the remote data. The movement data may be provided by a movement sensor included in sensor unit 203 of remote device 200. Based on the extracted body information of the sensor data and the extracted movement information of the remote data, operation 403 of determining a correlation measure between the sensor data and the remote data, and operation 407 of providing output data based on the information are performed. In particular, the correlation measure may be determined based on the body information extracted from the sensor data and the movement information extracted from the remote data according to the method illustrated in FIG. 15.

By extracting the body information and the movement information in operations 473, 474, complementary and/or related information can be provided from the sensor data and the remote data. A degree of correlation of the complementary and/or related information relative to a threshold can be determined in operation 403 by providing suitable correlation rules in operation 433. For instance, body information such as a heartrate of the user can be associated with movement information such as a physical activity performed by the user. Thus, when a positive correlation of such information may be determined in the sensor data and in the remote data, for instance in a comparison of the extracted body information and the extracted movement information in operation 435, 445, the degree of correlation may be determined to be above threshold in operation 448. In the contrary case, when no correlation of such information may be determined in the sensor data and in the remote data, the degree of correlation may be determined to be below threshold in operation 437, 447. The correlation rules provided in operation 433 can be based on a previously known mapping relationship between the information in the sensor data and the information in the remote data. The correlation rules may also be provided by a trained machine learning algorithm, as described in the following description.

The complementary and/or related information provided by the movement information extracted from the remote data in operation 474 with respect to the body information extracted from the sensor data in operation 473 can be exploited to provide the output data in operation 407 with the complementary and/or related information as compared to the sensor data, provided that the correlation measure between this information has been determined to be above threshold in operation 403. To provide the output data in operation 407, an operation for providing the output data can be selected between first operation 405 or second operation 406, for instance according to any of operations 404, 414, 424, 425 described above in conjunction with the methods illustrated in FIGS. 11, 12, and 13, depending on the correlation measure determined in operation 403. Before providing the output data in operation 407, in particular before first operation 405 or second operation 406 is selected and performed, operations 401, 473 of providing sensor data and extracting body information from the sensor data and/or operations 402, 472 of providing remote data and extracting body information from the remote data may be repeated. Thus, the output data may be based on updated body information and on updated movement information, as compared to the body information and movement information on which the determining of the correlation measure in operation 403 has been based.

To illustrate, the body information extracted from the sensor data may comprise information about a heartrate of a user wearing the hearing device, and the movement information extracted from the remote data may comprise information about a movement of a user wearing the remote device. When the correlation measure is determined to be above threshold, it can be assumed that the body information and the movement information are related in that they constitute complementary and/or related information. For instance, it may then be assumed that both the hearing device and the remote device are worn by the user. When the body information extracted from the sensor data indicates an increasing heartrate, and the movement information extracted from the remote data indicates a movement activity of the user, the output data may be based on both the body information in the sensor data and the movement information in the remote data and thus may indicate that the user is involved in a physical activity. When the sensor data indicates an increasing heartrate, and the remote data indicates no movement activity of the user, the output data may be again based on both the body information in the sensor data and the movement information in the remote data and thus may indicate that the user is involved in a stressful situation and/or carries a health risk.

Additionally or alternatively, other complementary and/or related information may be extracted from the sensor data and the remote data in operations 473, 474. For instance, at least one of movement information, proximity information, audio information, location information, temperature information, altitude information, and body information may be extracted from the sensor data, and at least another one of these information types may be extracted from the remote data.

Moreover, redundant, and/or related information from the sensor data and the remote data may be provided in addition to operations 473, 474, according to operations 471, 472 as described above, by extracting at least one of the same type of information from the sensor data and the remote data. For instance, movement information and/or audio information and/or proximity information and/or body information and/or location information and/or temperature information and/or altitude information may be extracted from both the sensor data and the remote data. In this way, the methods illustrated in FIGS. 18 and 19 may be advantageously combined. As a result, a reliability of the correlation measure determined in operation 403 may be enhanced. In addition, the output data provided in operation 407 may be provided at a better accuracy and with an increased information content as compared to the sensor data, by including information from the remote data, when the correlation measure is determined to be above the threshold.

Figure 21:
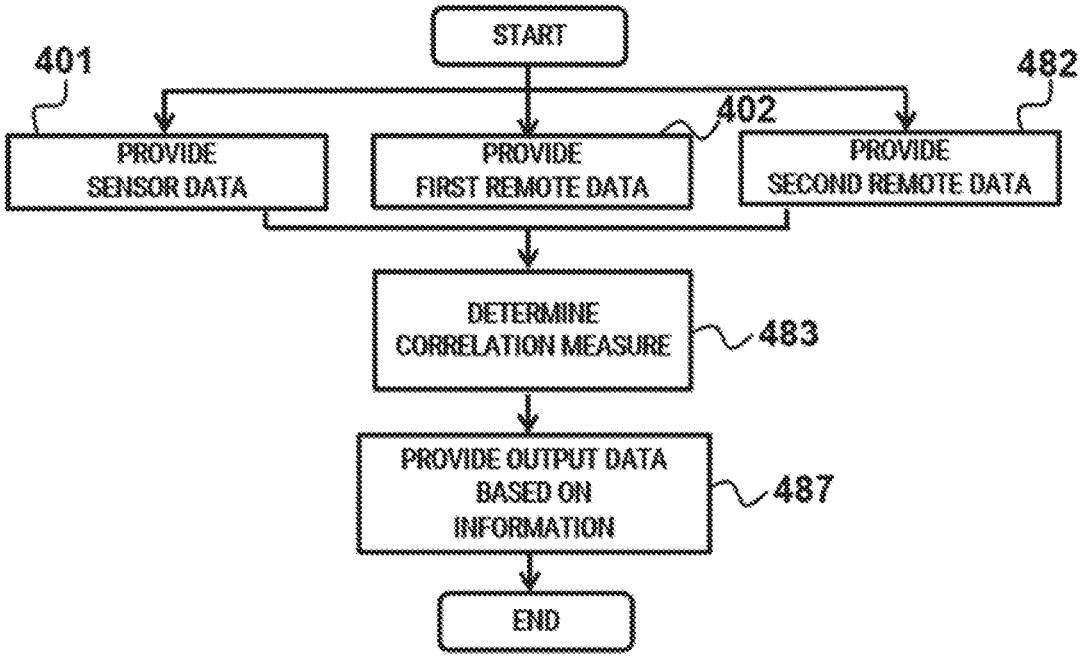

FIG. 21 illustrates a method of operating a hearing device and/or a communication system according to some embodiments of the present disclosure. The method may be automatically performed by processing unit 102 and/or processing unit 202. The method may be implemented in sensor data processing program 308 and/or sensor data processing program 328.

The remote data provided in operation 402 is first remote data. In addition, second remote data is provided in operation 482. The second remote data can be provided by a second remote device corresponding to first remote data provided by a first remote device. For instance, the first remote data may be provided by first remote device 200, and the second remote data may be provided by second remote device 250. Hearing device 100, first remote device 200, and second remote device 250 may be included in a communication system, for instance communication system 341 illustrated in FIG. 20.

In operation 483, a correlation measure between the sensor data and the first remote data and the second remote data is determined. The correlation measure can indicate a degree of correlation between information in the sensor data, information in the first remote data, and information in the second remote data relative to a threshold. The correlation measure can be determined in the same way as in operation 403 described above.

In particular, the method illustrated in FIG. 15 may be correspondingly applied. The information compared in operation 435, 445 then comprises information from the sensor data, information from the first remote data, and information from the second remote data. In some implementations, the sensor data is compared with the first remote data, and the sensor data is also compared with the second remote data. Thus, a first correlation measure can be determined for the sensor data and the first remote data separately from a second correlation measure determined for the sensor data and the second remote data. In some implementations, the sensor data is compared with the first remote data and with the second remote data at the same time. Thus, a single correlation measure can be determined for the sensor data, the first remote data, and the second remote data.

In an evaluation of the comparison in operation 436, 446, as illustrated in FIG. 15, the correlation measure of the compared information, which may be provided at different times, can be determined to be below threshold or above threshold. In some implementations, when the sensor data has been compared with the first remote data, and the sensor data has also been compared with the second remote data, the first correlation measure can be determined to be below threshold or above threshold, and the second correlation measure can be determined to be below threshold or above threshold. In some implementations, when the sensor data has been compared with the first remote data and with the second remote data at the same time, the single correlation measure can be determined to be below threshold or above threshold. In case of a negative outcome of the respective comparison, the respective correlation measure based on the compared information can be determined to be below the threshold. In case of a positive outcome of the respective comparison at the different times, the respective correlation measure based on the compared information can be determined to be above the threshold in operation 448.

In operation 487, output data is provided. For this purpose, any of operations 404, 414, 424, 425 and operation 405 or operation 406, as illustrated in FIGS. 11, 12, 13, may be correspondingly applied. In any of operations 404, 414, 424, 425, first operation 405 or second operation 406 can be selected depending on the correlation measure determined in operation 483.

In first operation 405, information for the output data can be provided based on information including information in the first remote data and/or information in the second remote data, wherein information in the sensor data may also be included. In some implementations, when the first correlation measure has been determined to be above threshold, information for the output data can be provided based on information including information in the first remote data. When the second correlation measure has been determined to be above threshold, information for the output data can be provided based on information including information in the second remote data. In some implementations, when the single correlation measure has been determined to be above threshold, information for the output data can be provided based on information including information in the first remote data and information in the second remote data.

In second operation 406, information for the output data can be provided based on information in the sensor data, wherein information in the first remote data and/or in the second remote data can be disregarded in the output data. In some implementations, when the first correlation measure has been determined to be below threshold, the information in the first remote data can be disregarded in the output data. When the second correlation measure has been determined to be below threshold, the information in the second remote data can be disregarded in the output data. In some implementations, when the single correlation measure has been determined to be below threshold, the information in the first remote data and in the second remote data can be disregarded in the output data.

By employing remote data from many different remote devices in addition to the sensor data to provide the output data in operation 487 in the above described way, as illustrated in FIG. 21, various advantages can be achieved. For instance, when a communication link between the hearing device and one of the remote devices deteriorates or is interrupted, or when the remote device was not able to generate the remote data for a certain period, determining the correlation measure below the threshold can ensure that the deteriorated remote data is not considered for the information in the output data. Instead, when the first correlation measure determined for the first remote data is below the threshold and the second correlation measure determined for the second remote data is above threshold, the second remote data can be envisaged as a replacement for the first remote data. Moreover, by employing remote data from many different remote devices, determining the correlation measure relative to the threshold may have an increased reliability due to a gain of information from the multiple remote data, in particular when a single correlation measure is determined based on information in the sensor data and the multiple remote data. The remote data from a plurality of remote devices may also be employed for distributed classification tasks when the correlation measure is determined and/or when the output data is provided. For instance, the remote devices may be locally distributed such that the respective remote data may comprise location specific information which may be useful to adjust the output data according to the location specific information, for instance to provide a calibration of the sensor data in the output data. When the remote devices are interconnected via a communication network including a server, also cloud based data storage and/or cloud based calculations for determining the correlation measure and/or for providing the output data can be envisaged.

Figure 22:
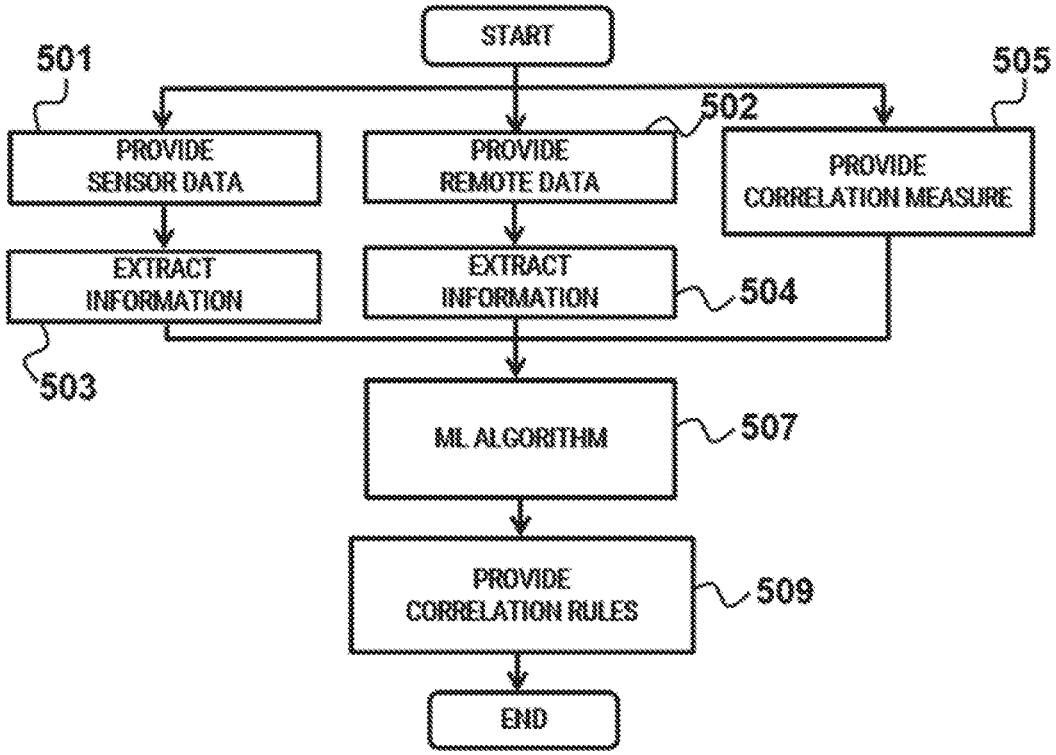
FIGS. 22, 23 illustrate exemplary methods of obtaining correlation rules between sensor data and remote data for obtaining a degree of correlation between the data.

FIG. 22 illustrates a method of providing correlation rules for determining a degree of correlation between sensor data and remote data. For instance, the method may be employed in the method illustrated in FIG. 15 in the place of operation 433 to provide correlation rules for the comparison in operation 435, 445. The method may be automatically performed by processing unit 102 and/or processing unit 202. The method may also be performed by any data processor external from hearing device 100 and remote device 200. In particular, the method may also be performed by a server and/or in a cloud connectable to hearing device 100 and/or remote device 200 via a communication link, in particular a communication network. The method may also be implemented in sensor data processing program 308 and/or sensor data processing program 328.

In operation 501, sensor data is acquired for many times, and in operation 502, associated remote data is acquired for the number of times. The data is acquired as a training set for a machine learning (ML) algorithm executed in operation 507. For instance, operation 501 may comprise repeating operation 401 of providing the sensor data for the number of times. Operation 502 may comprise repeating operation 402 of providing the remote data for the number of times. The number of times is selected to be appropriate for the training of the ML algorithm in operation 507 such that a predictive model can be provided by the ML algorithm. Moreover, information may be extracted from the collected sensor data in operation 503 and from the collected remote data in operation 504 to provide feature vectors in the training set suitable for the training of the ML algorithm. Thus, at least a feature vector of the sensor data may be provided containing the extracted information acquired for the number of times, and at least an associated feature vector of the remote data may be provided containing the extracted information acquired for the number of times.

In addition, for each sensor data acquired at a time, in particular for each information extracted from the sensor data, and for each remote data acquired at the time, in particular for each information extracted from the remote data, a correlation measure is provided in operation 505. The correlation measure indicates a degree of correlation between the information in the sensor data and the information in the remote data for the number of times the data has been collected. The correlation measure can be based on any information which allows to quantify the degree of correlation between the information in the sensor data and in the remote data. For instance, the correlation measure can be based on observations of changes in the information in the sensor data and the remote data when the user is wearing the hearing device and the remote device as compared to when the user is not wearing the hearing device and/or the remote device. The correlation measure provided for the number of times is employed to label the training set. In particular, the correlation measure provided for the number of times may be aggregated in a label vector.

Thus, a matrix including at least one column containing a feature vector of the sensor data, at least one column containing a feature vector of the remote data, and another column containing the label vector may be formed. The matrix can then be input in the ML algorithm executed in operation 507.

The ML algorithm executed in operation 507 is configured to provide a predictive model for a correlation measure between information in the sensor data and information in the remote data. To this end, any statistical learning algorithm or pattern recognition algorithm known in the art may be employed, including, for instance, a Bayesian classifier and/or logistic regression and/or a decision tree and/or a support vector machine (SVM) and/or a (deep) neural network and/or a convolutional neural network and/or an algorithm based on Multivariate analysis of variance (Manova). Moreover, instead of only one machine learning algorithm, several machine learning algorithms connected in parallel may be used. The predictive model produced by the ML algorithm can thus be based on a pattern of information in the sensor data and remote data. The predictive model can be provided with an input of information in the sensor data, for instance as provided in operation 401, and an input of information in the remote data, for instance as provided in operation 402. The predictive model can allow to determine a probability and/or likelihood of a degree of correlation between the input information in the sensor data and in the remote data. By maximizing the probability and/or likelihood, a prediction of the most probable and/or most likely correlation measure can thus be determined.

In operation 509, correlation rules for a comparing information in the sensor data and remote data with respect to their degree of correlation are provided. The comparison may be performed by inputting the sensor data and the remote data into the predictive model produced by the ML algorithm in operation 507. In this way, the correlation rules can be provided by the predictive model by maximizing the probability and/or likelihood of the degree of correlation between the input information in the sensor data and in the remote data.

Operation 509 may thus be employed in a method for determining the correlation measure between the information in the sensor data and in the remote data. In particular, operation 509 may be employed in the place of operation 433 of providing the correlation rules in the method illustrated in FIG. 15. The comparison in operations 435, 445 may then be performed by inputting the sensor data and the remote data into the predictive model produced by the ML algorithm in operation 507.

Figure 23:
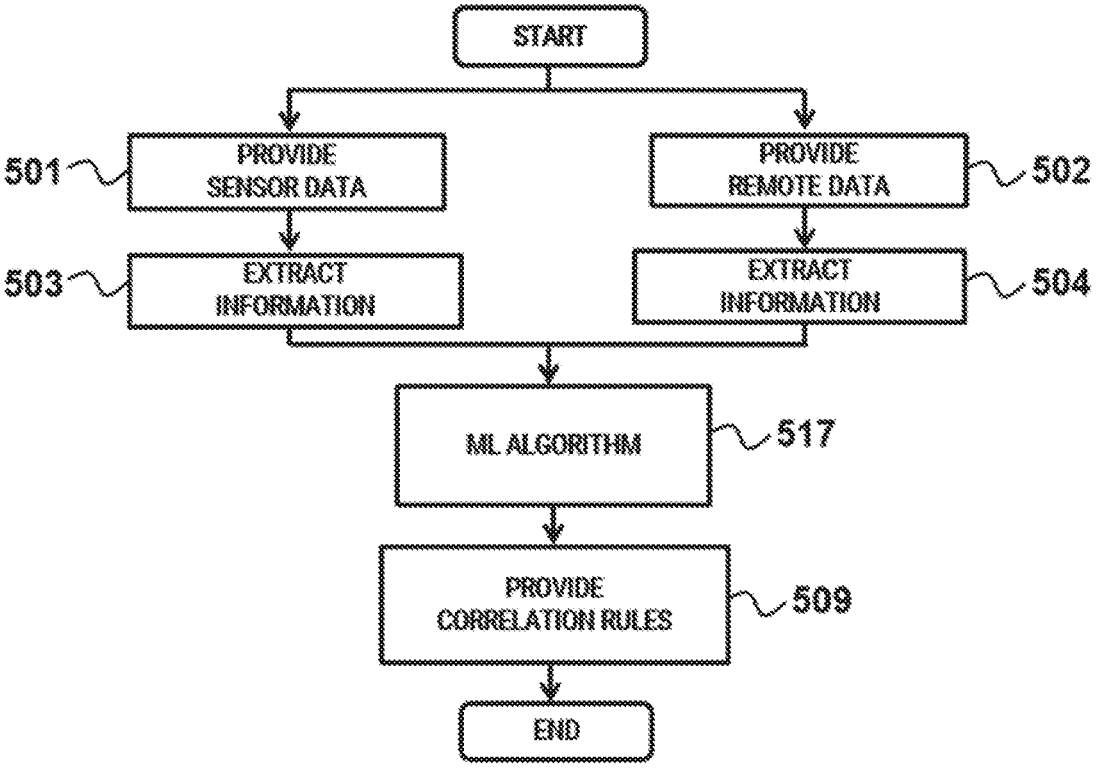

FIG. 23 illustrates a method of providing correlation rules for determining a degree of correlation between sensor data and remote data. For instance, the method may be employed in the method illustrated in FIG. 15 in the place of operation 433 to provide correlation rules for the comparison in operation 435, 445. The method may be automatically performed by processing unit 102 and/or processing unit 202. The method may also be performed by any data processor external from hearing device 100 and remote device 200. In particular, the method may also be performed by a server and/or in a cloud connectable to hearing device 100 and/or remote device 200 via a communication link, in particular a communication network. The method may also be implemented in sensor data processing program 308 and/or sensor data processing program 328.

A training set for a machine learning (ML) algorithm executed in operation 517 is provided by the sensor data collected in operation 501 and by the remote data collected in operation 502. In particular, at least a feature vector of the sensor data may be provided containing the extracted information acquired for the number of times in operation 501, and at least an associated feature vector of the remote data may be provided containing the extracted information acquired for the number of times in operation 502. A matrix including at least one column containing a feature vector of the sensor data and at least one column containing a feature vector of the remote data can be input in the ML algorithm executed in operation 517.

The ML algorithm executed in operation 507 is configured to provide a predictive model for a correlation measure between information in the sensor data and information in the remote data. The ML algorithm is configured to group the input information in the sensor data and the information in the remote data in various subgroups, wherein the subgroups can indicate a respective degree of correlation between the information in the sensor data and in the remote data. The subgroups can be formed by clustering the input information in the sensor data and the input information in the remote data based on their probabilities and/or likelihood. To this end, any clustering algorithm known in the art may be employed, including, for instance, k-means clustering and/or mean-shift clustering and/or agglomerative hierarchical clustering and/or expectation maximization clustering and/or density based spatial clustering. The predictive model can thus be based on a distance between classified points which have been clustered into the various subgroups. Information in the sensor data, for instance as provided in operation 401, and information in the remote data, for instance as provided in operation 402, can then be input into the predictive model. The predictive model can allow to determine a distance of the input data to a center of the various subgroups formed by the clustering. By selecting a subgroup with a minimum distance, and thus maximizing the probability and/or likelihood that the input data matches a certain degree of correlation, a prediction of the most probable and/or most likely correlation measure can be determined.

The correlation rules provided in operation 509 can thus also be based on the predictive model produced by clustering in the ML algorithm in operation 517.

While the principles of the disclosure have been described above in connection with specific devices, systems and methods, it is to be clearly understood that this description is made only by way of example and not as limitation on the scope of the invention. The above described preferred embodiments are intended to illustrate the principles of the invention, but not to limit the scope of the invention. Various other embodiments and modifications to those preferred embodiments may be made by those skilled in the art without departing from the scope of the present invention that is solely defined by the claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A hearing device comprising:

a sensor unit configured to provide sensor data, the sensor data associated with a physical property detected on a hearing device user and/or in an environment of the hearing device;

a communication unit configured to receive remote data from a remote device via a communication link; and a processing unit communicatively coupled with the sensor unit and the communication unit, wherein the processing unit is configured to:

determine whether a degree of correlation between information in the sensor data and information in the remote data is above or below a threshold;

select, based on said degree of correlation relative to the threshold, an operation for providing output data from a first operation and a second operation, wherein the first operation is based on information including information in the remote data, wherein the second operation is based on information in the sensor data such that information in the remote data is disregarded in the output data; and provide the output data by performing the selected first or second operation.

2. The hearing device according to claim 1, wherein the processing unit is further configured to select the first operation when said degree of correlation is determined to be above the threshold, and to select the second operation when said degree of correlation is determined to be below the threshold.

3. The hearing device according to claim 1, wherein the processing unit is further configured to select the first operation when said degree of correlation is determined to be below the threshold, and to select the second operation when said degree of correlation is determined to be above the threshold.

4. The hearing device according to claim 1, wherein said threshold is a first threshold, wherein the processing unit is further configured to determine whether said degree of correlation is above or below a second threshold, the first threshold representing a lower degree of correlation between the information in the sensor data and the information in the remote data than the second threshold, and to select the first operation when said degree of correlation is determined to be above the first threshold and below the second threshold, and to select the second operation when said degree of correlation is determined to be below the first threshold or above the second threshold.

5. The hearing device according to claim 1, wherein the processing unit is further configured to select the first operation from a third operation and a fourth operation, wherein in the third operation the output data is based on information including information in the sensor data and information in the remote data, and in the fourth operation the output data is based on information in the remote data such that information in the sensor data is disregarded in the output data.

6. The hearing device according to claim 5, wherein said threshold is a first threshold, wherein the processing unit is further configured to determine whether said degree of correlation is above or below a second threshold, the first threshold representing a lower degree of correlation between the information in the sensor data and the information in the remote data than the second threshold, and to select the third operation when said degree of correlation is determined to be above the first threshold and below the second threshold, to select the second operation when said degree of correlation is determined to be below the first threshold, and to select the fourth operation when said degree of correlation is determined to be above the second threshold.

7. The hearing device according to claim 1, wherein the sensor unit is further configured to provide the sensor data with information depending on whether the hearing device is worn at the ear of the user, wherein the information in the remote data and the threshold is selected such that said degree of correlation is determined by the processing unit to be above the threshold when the remote device is worn by the user in addition to the hearing device worn at the ear of the user.

8. The hearing device according to claim 1, wherein the sensor unit is configured to provide the sensor data with proximity information indicative of a proximity of the hearing device to the remote device and/or with connection information indicative of a quality of a connection of the hearing device to the remote device via the communication link, wherein the processing unit is configured to determine said degree of correlation to be above the threshold when the proximity information indicates that a minimum proximity is exceeded and/or when the connection information indicates that a minimum connection quality is exceeded, and when the information in the remote data fulfills another criterion which is independent of said proximity and/or said quality of the connection.

9. The hearing device according to claim 1, wherein the sensor unit is further configured to provide the sensor data with body information indicative of a physical property of the user wearing the hearing device and/or with movement information indicative of a movement and/or orientation of the hearing device, wherein the processing unit is configured to determine said degree of correlation between the information in the sensor data including said body information and/or movement information and the information in the remote data, wherein the information in the remote data is including movement information indicative of a movement and/or orientation of the remote device and/or location information indicative of a location of the remote device.

10. The hearing device according to claim 1, wherein the sensor unit is configured to provide the sensor data with audio information indicative of a sound in an environment of the hearing device, wherein the processing unit is configured to determine said degree of correlation between the information in the sensor data including said audio information and the information in the remote data, wherein the information in the remote data is including audio information indicative of a sound in an environment of the remote device.

11. A communication system comprising:

a hearing device configured to be worn at an ear of a user, and a remote device operable at a position remote from the ear at which the hearing device is worn and configured to provide remote data, wherein the hearing device comprises a sensor unit configured to provide sensor data, the sensor data associated with a physical property detected on the user and/or in an environment of the hearing device, wherein both the hearing device and the remote device comprising a communication unit configured to communicate the sensor data and/or the remote data via a communication link, wherein either the hearing device or the remote device comprises a processing unit communicatively coupled with the respective communication unit, wherein the processing unit is configured to:

determine whether a degree of correlation between information in the sensor data and information in the remote data is above or below a threshold;

select, depending on said degree of correlation relative to the threshold, an operation for providing output data from a first operation and a second operation, wherein in the first operation the output data is based on information including information in the remote data, and in the second operation the output data is based on information in the sensor data such that information in the remote data is disregarded in the output data; and provide the output data by performing the selected operation.

12. The communication system according to claim 11, wherein the remote device is wearable by the user, wherein the information in the remote data depends on whether the remote device is worn by the user.

13. The communication system according to claim 11, wherein the remote device is a first remote device, wherein the communication unit of the first remote device is configured to establish a communication link with a communication unit of a second remote device and to receive data from the second remote device via the communication link, wherein the remote data provided from the first remote device to the communication unit of the hearing device comprises the data received by the first remote device from the second remote device.

14. The communication system according to claim 13, wherein the communication link between the communication unit of the first remote device and the communication unit of the second remote device comprises an internet connection and/or a mobile phone connection.

15. A method of operating a hearing device:

communicating sensor data and/or remote data via a communication link between a hearing device and a remote device;

determining whether a degree of correlation between information in the sensor data and information in the remote data is above or below a threshold;

selecting, depending on the degree of correlation relative to the threshold, an operation for providing output data from a first operation and a second operation, wherein the first operation is based on information including information in the remote data, and wherein the second operation is based on information in the sensor data such that information in the remote data is disregarded in the output data; and providing the output data by performing the selected operation.

16. The method of claim 15, wherein the threshold is a first threshold, the first threshold representing a lower degree of correlation between the information in the sensor data and the information in the remote data than the second threshold.

17. The method of claim 15, the method further comprising:

providing the sensor data with information based on determining whether the hearing device is worn at the ear of a hearing device user.

18. The method of claim 15, the method further comprising:

providing the sensor data with audio information indicative of a sound in an environment of the hearing device; and determining the degree of correlation between the information in the sensor data including said audio information and the information in the remote data, wherein the information in the remote data is including audio information indicative of a sound in an environment of the remote device.

* * * * *